United States Patent [19]

Ogawa

[11] Patent Number: 5,011,768

[45] Date of Patent: Apr. 30, 1991

[54] SILVER HALIDE PHOTOGRAPHIC MATERIAL

[75] Inventor: Tadashi Ogawa, Kanagawa, Japan

[73] Assignee: Fuji Photo Film Co., Ltd., Kanagawa, Japan

[21] Appl. No.: 291,021

[22] Filed: Dec. 28, 1988

[30] Foreign Application Priority Data

Dec. 28, 1987 [JP] Japan ..... 62-335573

[51] Int. Cl.[5] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 4,399,215 | 8/1983 | Wey | 430/569 |
| 4,469,784 | 9/1984 | Heki et al. | 430/569 |
| 4,631,253 | 12/1986 | Mifune et al. | 430/569 |
| 4,769,315 | 9/1988 | Suda et al. | 430/567 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material is described having high speed and excellent latent image storage properties wherein pressure fogging does not readily occur.

6 Claims, No Drawings

SILVER HALIDE PHOTOGRAPHIC MATERIAL

FIELD OF THE INVENTION

This invention relates to silver halide photographic materials having excellent photographic stability.

BACKGROUND OF THE INVENTION

Many methods are known in industry for the manufacture of silver halide emulsions. Disclosures concerning methods of production are found in *Chemie et Physique Photographique* by P. Glafkides, Paul Montel Co., 1967; *Photographic Emulsion Chemistry* by G. F. Duffin, Focal Press Co., 1966; and in *Making and Coating Photographic Emulsions* by V. L. Zelikman, Focal Press Co., 1964, etc. Silver halides include silver bromide, silver iodide, silver chloride, and mixed crystals of silver iodobromide and silver chlorobromide etc. The acid method, neutral method, ammonia method etc. are various methods used for the production of silver halide emulsion. The single jet method, double jet method and a combination thereof are used as methods for reacting soluble silver salts and soluble halogen salts. Furthermore, the controlled double jet method maintains the silver ion concentration constant during the formation of the silver halide crystals.

Generally, the acid method is most often used in the production of lower speed, silver halide crystal grains having relatively fine grains. Conversely, the ammonia method is most often used in the production of higher speed silver halide crystal grains having relatively large grains. With ammonia method, the solubility of the silver halide is increased as a result of the formation of silver ions and complex ions. Thus, it is easy to grow large grains using the ammonia method.

The acid method is often used for production of silver chloride and silver chlorobromide emulsions while the ammonia method is frequently used for production of high speed silver iodobromide emulsions.

The acid method is preferably used in the production of silver chloride or silver chlorobromide emulsions in photographic materials where large grains are not required for high speed performance. Alternatively, it may be sufficiently possible to realize larger grain sizes without using a silver halide solvent such as ammonia due to the high acid solubility of silver chloride or chlorobromide as compared to silver iodobromide. Furthermore, the pH of the system increases unavoidably when ammonia is used in the production process. Compared with silver iodobromide, silver chloride and silver chlorobromide are susceptible to fog when processed under alkaline conditions.

On the other hand, silver chloride and silver chlorobromide emulsions are widely used in photographic prints, noteably color prints. Photographic stability, from production of the photosensitive materials until their use under various prevailing conditions is important to allow rapid processing of these materials.

Specific characteristics related to handling include reliability under various exposure conditions; namely exposure luminance and exposure temperature etc., latent image shelf-life under storage conditions from exposure until processing, reliability under various processing conditions, and pressure resistance during these processes.

Hitherto, photographic materials have made some remarkable advances in these respects but have not yet reached a satisfactory level. In particular, with the recent development of mini laboratories, different processing conditions are employed as compared to those in conventional large-scale developing laboratories. The emphasis on the performance demands of the photosensitive materials is also changing accordingly.

SUMMARY OF THE INVENTION

An objective of this invention is to provide photographically stable photographic materials, specifically with regard to improvement of latent image stability and pressure characteristics. In particular, the present invention improves short term latent image stability following exposure.

The inventors have discovered that the aims of the invention can be achieved by the material below.

(1) A silver halide light-sensitive photographic material comprising a support having thereon at least one photographic layer containing a chemically sensitized and spectrally sensitized silver halide emulsion wherein said silver halide emulsion comprises silver chlorobromide crystal grains having, within the crystal grain, at least two phases wherein the silver halide grains differ in their silver bromide content by not less than 10 mol % and wherein said crystal grains are formed in a grain forming stage at a pH of not less than 7.6 and not more than 10.8 and essentially in the absence of ammonia.

(2) A silver halide photographic materials as in (1) wherein the silver halide crystal grains are mainly composed of grains enclosed in the (100) crystal plane.

(3) A silver halide photographic materials as in (1) wherein the partial structure of the silver halide crystal grains is mainly composed of a core/shell structure.

(4) A silver halide photographic material as in (1) wherein iridium ions are contained in at least one location of the partial structure of the silver halide crystal grains.

(5) A silver halide photographic materials as in (1) wherein the silver halide crystal grains are sulfur sensitized in the presence of nitrogen-containing heterocyclic compound.

(6) A silver halide photographic materials as mentioned in any one of sections (1) to (5) wherein nitrogen-containing heterocyclic mercapto compounds are contained in at least one layer above the support.

The term "essentially in the absence of ammonia" means that ammonia is contained in an amount of 10 mol % or less, preferably 1 mol % or less, more preferably 0.1 mol % or less per mol of silver and most preferably ammonia is not contained.

Silver halide emulsions may be produced under alkaline conditions using ammonia to increase the solubility of the silver halide crystals. It is comparatively rare to use ammonia with silver chlorobromide emulsions except where silver halide crystals with special shapes are desired such as the silver chloride-containing crystals disclosed in, for example, U.S. Pat. No. 4,339,215. Grain formation of silver chlorobromide without the use of ammonia at high pH is not normally carried out. A speed increase by means of electron capture brought about by introducing silver nuclei in octahedral silver bromide by reduction sensitization under conditions of high pH is disclosed in *Photographic Science and Engineering* 23, 113 (1979) by S. S. Collier. Also, it is reported in *Journal of Photographic Science* 1, 163 (1953) by H. W. Wood that the speed of silver bromide emulsions and silver chlorobromide emulsions increases with a high pAg or high pH. Even through these documents disclose inclusion of silver chloride in silver halide emulsions, these disclosures are not directed to silver chlorobromide emulsions having the multiphase structure of differing halogen composition of the present invention. Also, these references do not disclose the benefit of a high pH which distinguishes the present discovery of silver halide emulsions having a multiphase structure. Furthermore, there is a general disclosure concerning grain formation under alkaline conditions in the aforementioned *Chemie et Physique Photographique* by P. Glafkides, but there is no direct mention or suggestion concerning application to silver halide emulsions having the multiphase structure of the present invention. The present invention is based on the unexpected finding that, in the production of silver chlorobromide emulsions having a multiphase structure, treatment in a specific alkaline pH range brings about useful effects such as an increase of sensitivity, a stabilization of latent image, etc., which are not observed in silver halide emulsions which do not have the multiphase The silver halide emulsions which are advantageously used in the present invention comprise silver chlorobromides which essentially contain no silver iodide. "Essentially contains no silver iodide" means a silver iodide content of not more than 1 mol. %, preferably of not more than 0.5 mol. % and most preferably containing no silver iodide at all. In the emulsions of the present invention, the silver chloride to silver bromide content ratio may vary from close to pure silver chloride to close to pure silver bromide although it is desirable that the silver bromide content is not less than 0.3 mol. % and not more than 97 mol. %.

More desirably, the silver bromide content is not less than 0.5 mol. % and not more than 90 mol. %. When using the silver halide photographic materials of this invention in applications requiring rapid processing, emulsions with a low silver bromide content of, for example, not more than 20 mol. % or not more than 10mol. % may be used. In particular, if the silver bromide content is not more than 3 mol. %, not only is the processing speed increased, but the rapid development properties of the developing solution can also be enhanced. This is because the equilibrium concentration of the accumulated bromine ions in the developing solution, as influenced by the replenishment rate, is at a lower concentration.

It is preferable to increase the silver bromide content of the emulsion when using the present invention to obtain photographic materials with stable fogging, speed and gradation. A silver bromide content not less than 45 mol. % is preferred and not less than 60 mol. % is particularly preferred.

The crystal grains contained in a silver chlorobromide emulsion of the present invention must have at least two phase structure wherein the silver bromide content differs by not less than 10 mol %. If the silver chloride and the silver bromide content differ by at least 10 mol. %, the phase structure is not particularly limited in terms of the position within the crystal grain or the form in which it is present. Accordingly, the crystal grains of the present invention may have a so-called core/shell type structure or a multilayer core/shell structure wherein the inside and the surface of the crystal grains differ in their halogen compositions. Also, the crystal grains of the present invention may have a so-called junction type structure wherein a guest crystal of differing halogen composition is deposited and joined onto a site of a host crystal grain; for example, on a corner, edge or surface of the crystal grain. By means of halogen exchange, it is possible to induce a partial structure with a halogen composition different than that of the crystal grain prior to the exchange. Furthermore, it is also possible to combine these structures. For example, crystal grains with a core/shell structure may be used as host crystal grains for depositing guest crystals of differing halogen composition onto the surface of these grains. Halogen exchange may also be applied to crystal grains having a multilayer core/shell structure.

In partial structures formed in this manner, the core, for example, in a crystal grain with a core/shell structure, may have a high silver bromide content while the shell has a low silver bromide content, or the reverse may be the case. Furthermore, the boundaries in partial structures having differing halogen compositions may be distinct in terms of composition or may comprise continuously changing boundaries wherein mixed crystals are formed due to compositional differences.

There is no particular limitation to the compositional ratio in crystal grains having at least two phases of differing halogen composition. It is preferable to have a molar ratio of different phases between the core and the shell (in the crystal grains with the core/ shell structure) of from 2:98 to 98:2, for example, 2:98, 10:90, 30:70, 50:50, etc., and between the core, the intermediate layer and the shell in the crystal grains with the three phases structure of, for example, 2:8:90, 2:42:50, 10:10:80, 10:45:45, 33:33:34, etc.

The compositional molar ratio is preferably varied outside the range of from 2:98 to 98:2 when forming partial structures by means of halogen exchange. A compositional molar ratio of 98:2 or less is particularly preferred when subjecting silver chloride to halogen exchange using bromine-containing compounds. In practice, it is difficult to coat grain surfaces uniformly using halogen exchange. The halogen exchange material may not only be attached nonuniformly to corners and edges but may also be attached to crystal surfaces. In such cases, it is possible to make the halogen distribution uniform by placing the halogen exchange grains under conditions where Ostwald ripening readily occurs. When using silver halide grains of a core/shell type or a junction type according to the method of the present invention, a more preferable core to shell compositional molar ratio is between 5:95 and 95:5 and even more preferably between 7:93 and 90:10. Most preferably, it is between 15:85 and 80:20.

The difference in the silver bromide content of the core and shell varies with the compositional molar ratio of the core and the shell, and, although it is necessary that this difference be at least 10 mol. % and 100 mol. % or less, it is preferably not less than 10 mol. % and not more than 80 mol. %. It is most preferably not less than 10 mol. % and not more than 50 mol. %. If the difference in the silver bromide content within the multipart structure is small, this structure will be substantially similar to a grain of uniform structure. Conversely, if the compositional difference with the multi-part structure is too large, performance problems such as pressure desensitization readily occur. The appropriate compositional difference depends on the compositional ratio in the partial structure. It is preferable to make the compositional difference large as the structural contrast approaches 0:100 or 100:0; it is preferable to reduce the structural contrast to about 10 mol. % as the structural relation approaches 1:1.

The form of the silver chlorobromide grains used in this invention may be cubic, octahedral, tetradecahedral, or rhombic dodecahedral. Junction type grains in particular present a regular grain shape, forming regular junction crystals on the corners, edges and surfaces of the host crystal, although not in a regular form. Further, the silver chlorobromide grain may also have a spherical structure.

Octahedral grains or tetradecahedral grains are preferably used in this invention. Furthermore, cubic grains are particularly preferred. Crystal grains with a bonded structure as disclosed in Japanese Patent Application (OPI) No. 89,949/87 are also preferred. Tabular grains may also used. Emulsions of tabular grains having a grain diameter calculated as a circle to the grain thickness, 5 or more or 8 or less and which occupy 50 mol. % or more of the projected surface area of all grains can be used because these Emulsions have excellent rapid development properties. Such tabular grains having multi-part structural properties are preferred. (the term "OPI" as used herein means an "unexamined published application".)

The average grain size (calculated as the average diameter of a sphere of constant volume) of the silver halide emulsion grains used in this invention is preferably not more than 2μ and is least 0.1μ. A grain size of not more than 1.4μ and at least 0.15μ is particularly preferred. The particle size distribution may be narrow or wide. A monodisperse emulsion is preferred. In particular, a monodisperse emulsion of cubes, octahedrons, junction grains or tabular grains is preferred. Emulsions in which not less than 85%, and in particular not less than 90%, of all the particles by number or by weight come within ±20% of the average particle size are preferred. Furthermore, the use of such monodisperse emulsions comprising two or more kinds of mixed grains gives desirable results. When mixing and using two or more kinds of monodisperse emulsions, it is preferable to do so in proportions of not less than 5% and not more than 95% by weight respectively where the mixing ratio is calculated with respect to the weight of the silver component. It is preferable that the average grain size of the mixed emulsions differ by not less than 1:1.1 and not more than 1:8 calculated as a volume, and it is further preferable that they differ by not less than 1:1.2 and by not more than 1:6. When mixing two different kinds of monodisperse emulsions, it is preferable to use a mixing ratio of from 0.05:0.95 to 0.95:0.05 calculated with respect to the weight of the silver component, and it is further preferable to use a mixing ratio between 0.1:0.9 and 0.9:0.1.

The silver chlorobromide emulsions for use in the present invention can be produced by the methods disclosed in "Chemie et Physiqu Photographique" by P. glafkides, Paul Montel Co., 1967; *Photographic Emulsion Chemistry* by G. F. Duffin, Focal Press, 1966; and in *Making and Coating Photographic Emulsions* by V. L. Zelickman et al., Focal Press, 1964 etc. The one side mixing method, the simultaneous mixing method or any combination thereof etc. may be used to react the soluble silver salts and the soluble halogen salts. It is also possible to use the method in which the grains are formed in the presence of an excess of silver ions (i.e., the reverse mixing method). The controlled double jet method may also be used as a simultaneous mixing method. Using the controlled double jet method, a preferred mono-disperse silver halide emulsion with an orderly grain form and a narrow size distribution may be obtained. It is preferable to prepare grains for use in the present invention based on the simultaneous mixing method, including the double jet method.

The emulsions for use in the present invention are formed in a crystal grain forming stage under pH of not less than 7.6 and not more than 10.8 and essentially without ammonia. If such alkaline pH conditions are used in the grain forming stage, other method including the acid method, the neutral method and, in some circumstances, such as an increase of silver halide grain size, a change of shape of silver halide grain from a tabular grain to a block-like or spherical grain, a uniformity of internal composition of silver halide grain, etc. being required, the ammonia method, etc. may also be used conjointly. Preferably, at least 10%, more preferably at least 30% and most preferably at least 50% of the duration of the grain forming stage of the silver weight in the grain forming stage is carried out under such alkaline pH conditions.

In the silver halide grain forming or physical ripening stage, cadmium salts, zinc salts, lead salts, thalium salts, iridium salts or complex salts thereof, rhodium salts or complex salts thereof and iron salts or complex salts thereof etc. may be used together.

In particular, iridium salts or complex salts thereof may be used at $10^{-9}$ to $10^{-4}$ mol/mol and more preferably $10^{-8}$ to $10^{-5}$ mol/mol with respect to silver halide. The silver halide grains may be doped by concentrating the iridium salts in just one part of a multi-part crystal grain structure of the present invention or by dividing the iridium salts between each part. In comparison with emulsion prepared without iridium salts or complex salts thereof, emulsions doped with iridium salts are particularly useful for rapid development and stability when exposure is outside the proper illumination range; either at a high illumination or a low illumination.

If grain formation or physical ripening is carried out in the presence of a known silver halide solvent (for example, potassium thiocyanate or the thioethers and thione compounds etc. as disclosed in (OPI) U.S. Pat. No. 3,271,157 and JP-A-51-12360, 53-82408, 53-144319, 54-100717, 54-155828, etc.), (The term "JP-A" as used herein means an "unexamined published Japanese patent application"), a preferred monodisperse silver halide emulsion with a narrow grain size distribution and a uniform crystal form is obtained.

Noodle washing, the flocculation sedimentation method or ultrafiltration methods etc. can be used to remove the soluble salts from the emulsion after physical ripening.

With the silver halide emulsions used in this invention, chemical sensitization can be carried out with the single or joint use of selenium sensitization, reduction sensitization, noble metal sensitization etc. or sulfur sensitization. Thus, it is possible to use the active gelatin and sulfur sensitization methods which use compounds containing sulfur which react with silver ions (for example, thiosulfate salts, thiourea compounds, mercapto compounds, rhodanine compounds etc.), the reduction sensitization method which uses reducing substances (for example, stannous salts, amines, hydrazine derivatives, formamidine sulfinates, silane compounds etc.), and the precious metal sensitization method which uses precious metal compounds (for example, complex salts of metals in Group VIII of the Periodic Table such as mixed gold salts, platinum, iridium, palladium, rhodium and iron etc.) can be used singly or in combination according to the method of the present invention. Reduction sensitization can be affective even in emulsions of the present invention in which grain formation is carried out at a high pH. Sulfur sensitization or selenium sensitization are particularly preferred for use in the silver chlorobromide emulsions of the present invention since they do not readily cause fogging and since desired results can be obtained without the joint use of gold sensitization. Furthermore, it is preferred that nitrogen-containing heterocyclic compounds, for example, azaindene compounds as represented by 4-hydroxy-6-methyl-1,3,3a,7-tetrazaindene and/or mercaptoazole compounds as represented by 1-phenyl-5-mercap-totetrazole or 2-amino-5-mercapto-1,3,4- thiodiazole are present during chemical sensitization of the emulsions of the present invention.

In addition to chemically sensitization, if the silver chlorobromide emulsion of the present invention is spectrally sensitized, the effects of the invention are more pronounced.

The spectral sensitizing dyes used in the present invention are cyanine dyes, merocyanine dyes, compound merocyanine dyes etc. Apart from these, compound cyanine dyes, holopolar cyanine dyes, hemicyanine dyes, styryl dyes and hemioxonol dyes are used. Simple cyanine dyes, carbocyanine dyes, dicarbocyanine dyes are preferably used as cyanine dyes. These cyanine dyes are represented by the general formula (I) below.

General formula (I)

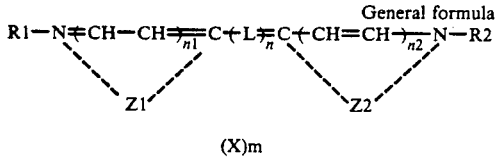

(X)m

In formula (I), L represents a methine group or substituted methine group, R1 and R2 each represent an alkyl group or substituted alkyl group, Z1 and Z2 each represent an atomic group forming a nitrogen-containing 5-or 6-membered heterocyclic nucleus and X represents an anion. n represents the integer 1, 3 or 5; n1 and n2 each represent the integer 0 or 1. When n=5, both n1 and n2 are 0; and when n=3, either n1 or n2 is 0. m represents the integer 0 or 1 and is 0 when forming an inner molecular salt. Furthermore, when n is 5, each may link to form a substituted or unsubstituted 5- or 6-membered ring.

The cyanine dyes represented by general formula (I) are described in greater detail below.

Lower alkyl groups (for example, methyl groups, ethyl groups etc.) and aralkyl groups (for example, benzyl groups and phenethyl groups etc.) are suitable substituent groups for the substituted methine group represented by L.

The alkyl residual groups represented by R1 and R2 may be linear chain, branched or cyclic. Furthermore, there are no limits to the number of carbon atoms comprising R1 and R2 though a range from 1 to 8 is preferred and a range of from 1 to 4 is particularly preferred. Furthermore sulfonate groups, carbonate groups, hydroxyl groups, alkoxy groups, acyloxy groups, aryl groups (for example, phenyl groups, substituted phenyl groups etc.) are suitable substituents for the substituted alkyl groups. These groups may be bonded to the alkyl groups either singly or in combination of two or more. Furthermore, the sulfonate groups and the carbonate groups may form a quaternary ion and salt of an organic amine and alkali metal ion. Here, "in combination of two or more" includes cases where these groups respectively bond to the alkyl group independently, and to cases in which these groups link and bond to the alkyl groups. Examples of the latter include the sulfoalkoxyalkyl group, sulfoalkoxyalkoxyalkyl group, carboxyalkoxyalkyl group and sulfophenylalkyl group.

Specific examples of R1 and R2 include; methyl groups, ethyl group, n-propyl group, n-butyl group, vinyl methyl group, 2-hydroxyethyl group, 4-hydroxybutyl group, 2-acetoxyethyl group, 3-acetoxypropyl group, 2-methoxyethyl group, 4-methoxybutyl group, 2-carboxyethyl group, 3-carboxypropyl group, 2-(2-carboxyethoxy)ethyl group, 2-sulfoethyl group, 3-sulfopropyl group, 3-sulfobutyl group, 4-sulfobutyl group, 2-hydroxy-3-sulfopropyl group, 2-(3-sulfopropoxy)ethyl group, 2-acetoxy-3-sulfopropyl group, 3-methoxy-2-(3-sulfopropoxy)propyl group, 2-[2-(3-sulfopropoxy)ethoxy]ethyl group, 2-hydroxy-3-(3'-sulfopropoxy)propyl group etc.

Specific examples of the nitrogen-containing heterocyclic nuclei formed by Z1 or Z2 include the oxazole nucleus, thiazole nucleus, selenazole nucleus, imidazole nucleus, pyridine nucleus, oxazoline nucleus, nucleus, selenazoline nucleus, imidazoline nucleus, and nuclei in which the benzene ring, naphthalene ring or other saturated or unsaturated carbon ring has been condensed are also available. Substituent groups (for example, alkyl group, trifluoromethyl group, alkoxycarbonyl group, cyano group, carboxyl group, carbamoyl group, alkoxy group, aryl group, acyl group, hydroxyl group, halogen atom etc.) may be further bonded onto these nitrogen-containing hetero rings.

Examples of the anion represented by X include, $Cl^-$, $Br^-$, $I^-$, $SO_4^{--}$, $NO_3^-$, $ClO_4^-$, etc.

Specific examples of the cyanine dyes represented by general formula (I) are shown below.

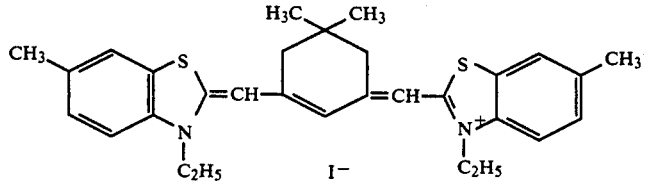

(V-1)

-continued
(V-2)
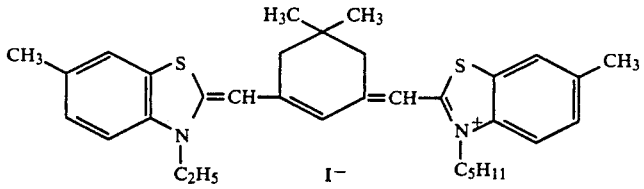
(V-3)
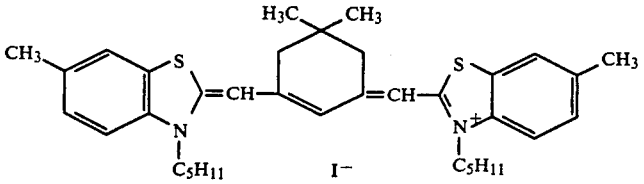
(V-4)
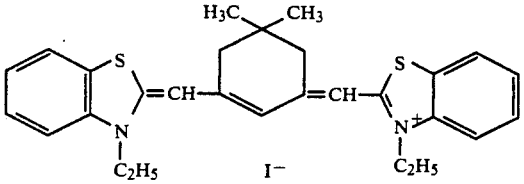
(V-5)
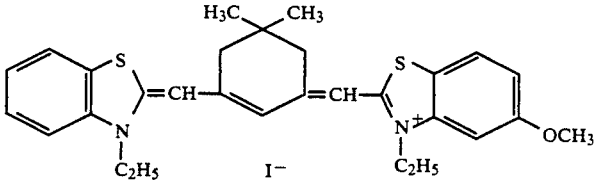
(V-6)
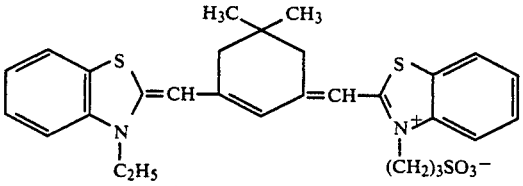
(V-7)
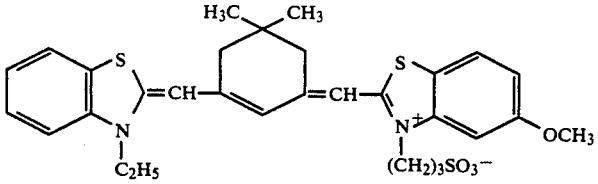
(V-8)
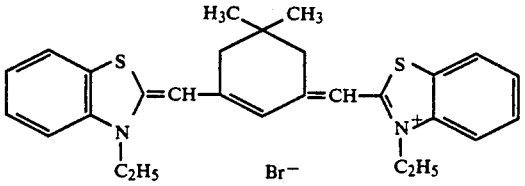
(V-9)
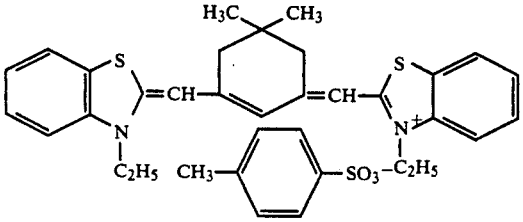

-continued
(V-10)
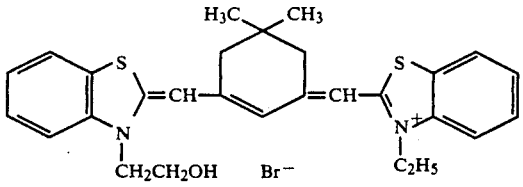
(V-11)
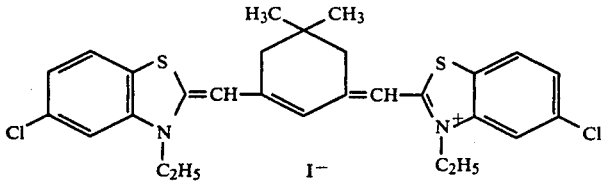
(V-12)
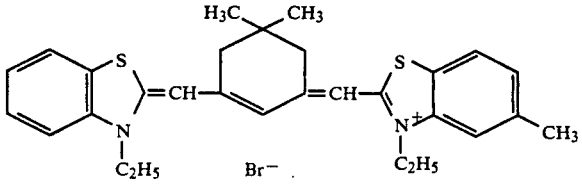
(V-13)
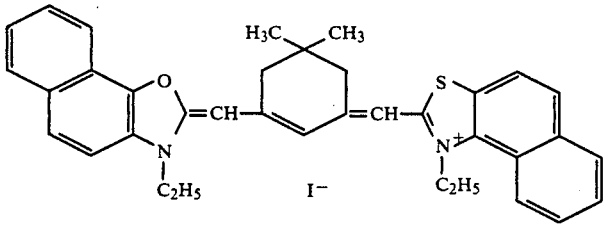
(V-14)
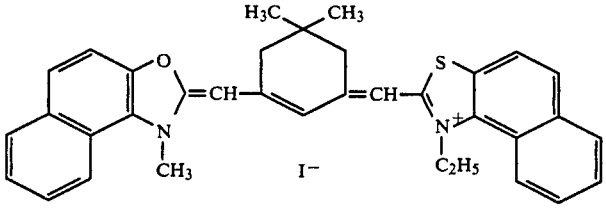
(V-15)
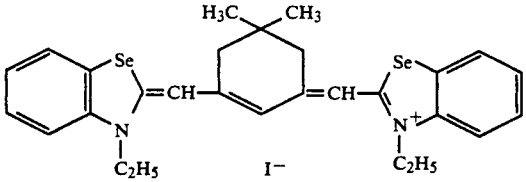
(V-16)
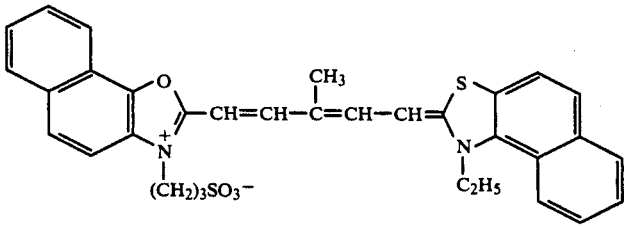
(V-17)
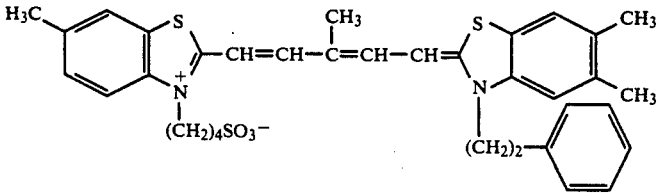

-continued
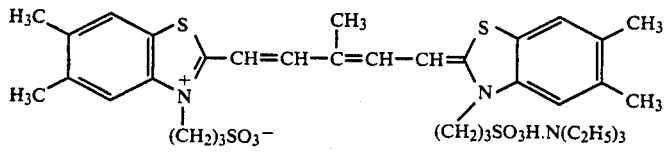
(V-18)
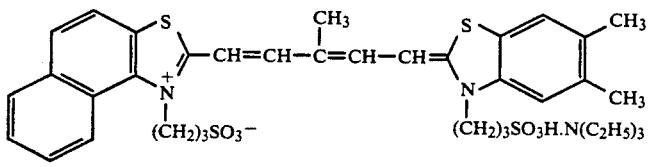
(V-19)
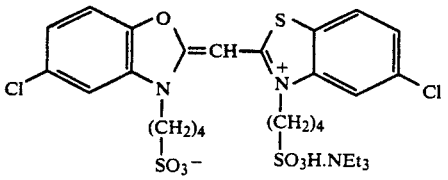
(V-20)
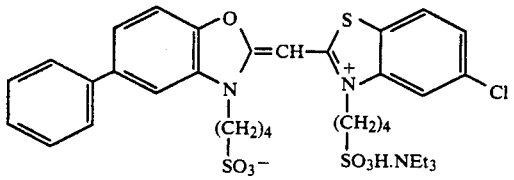
(V-21)
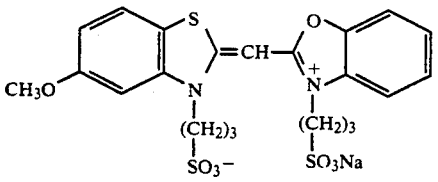
(V-22)
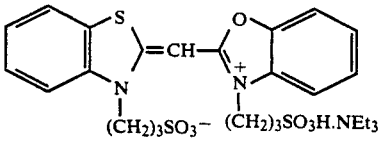
(V-23)
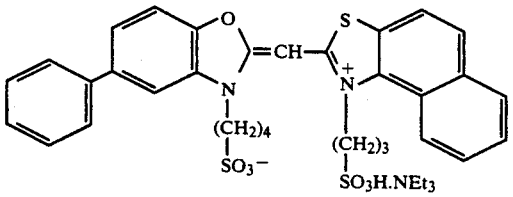
(V-24)
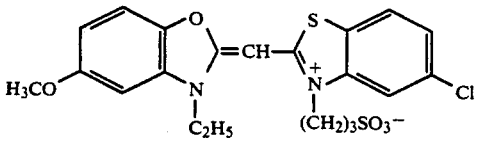
(V-25)
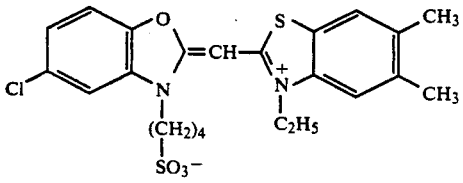
(V-26)

-continued
(V-27)
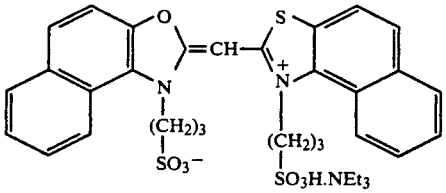
(V-28)
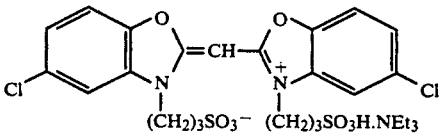
(V-29)
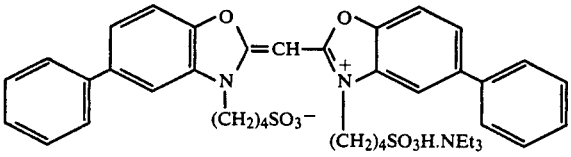
(V-30)
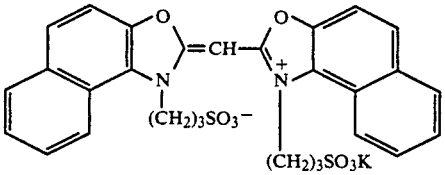
(V-31)
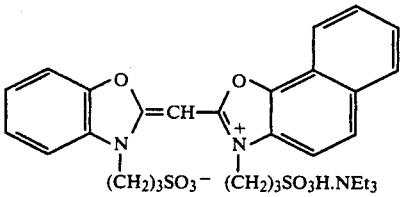
(V-32)
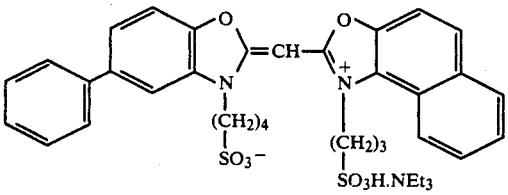
(V-33)
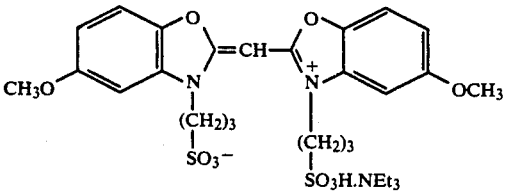
(V-34)
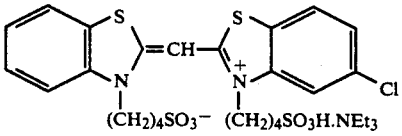
(V-35)
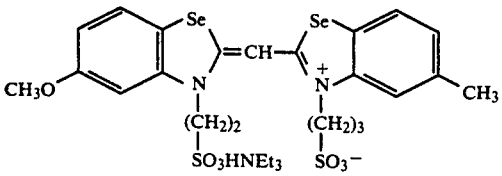

-continued
(V-36)
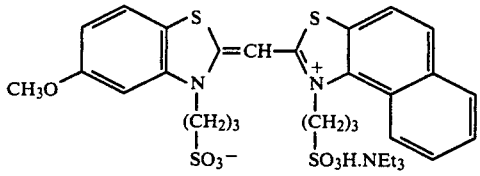
(V-37)
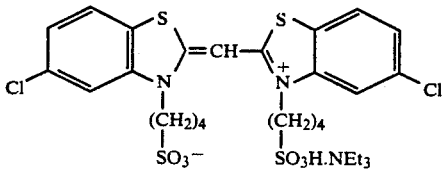
(V-38)
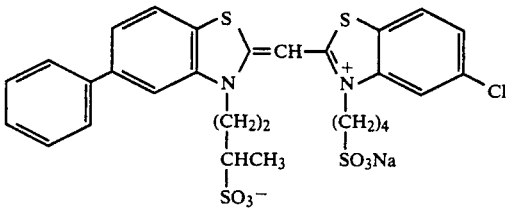
(V-39)
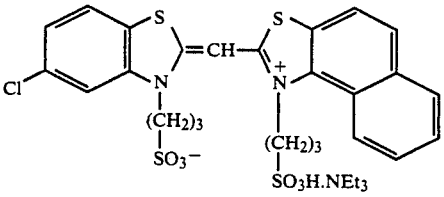
(V-40)
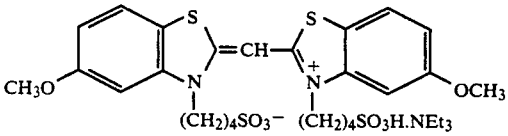
(V-41)
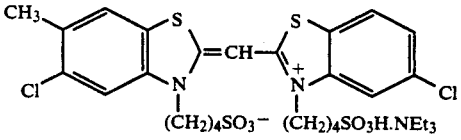
(V-42)
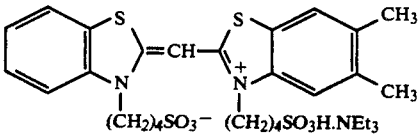
(V-43)
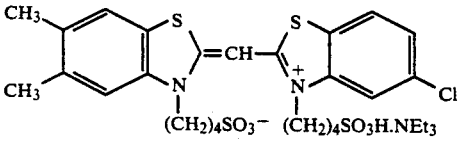

-continued
(V-44)
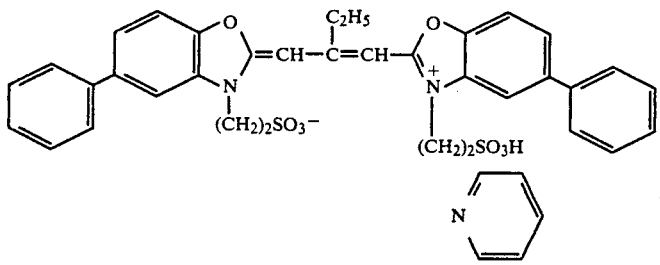
(V-45)
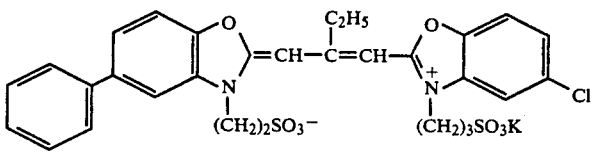
(V-46)
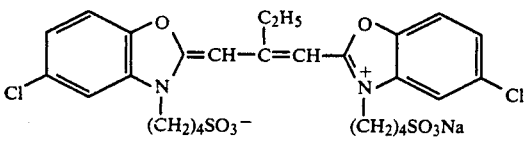
(V-47)
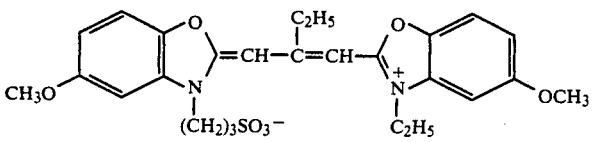
(V-48)
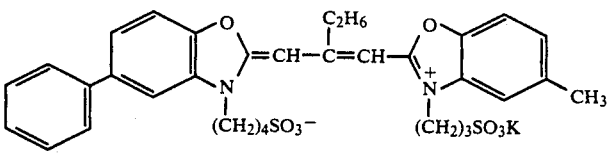
(V-49)
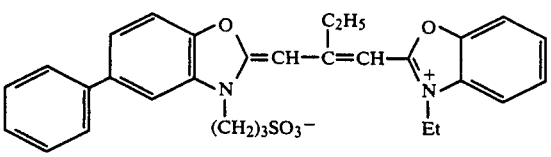
(V-50)
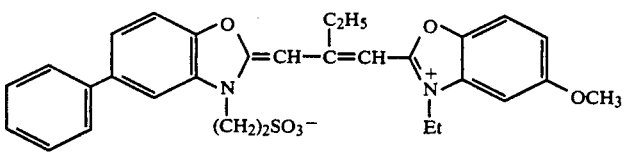
(V-51)
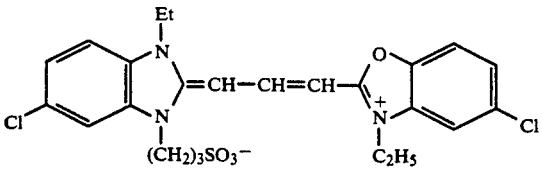
(V-52)
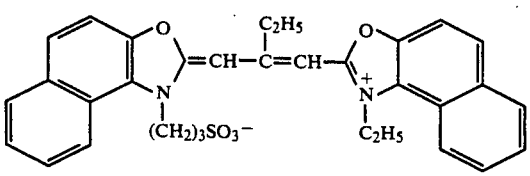

-continued (V-53)

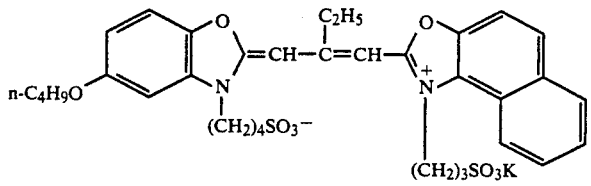

(V-54)

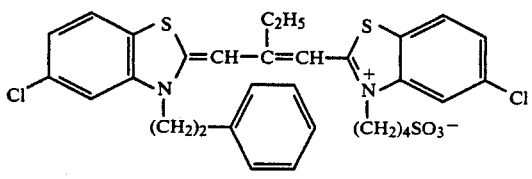

(V-55)

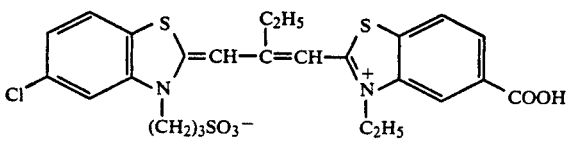

(V-56)

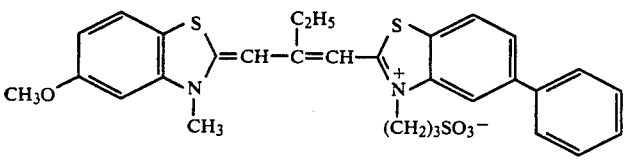

(V-57)

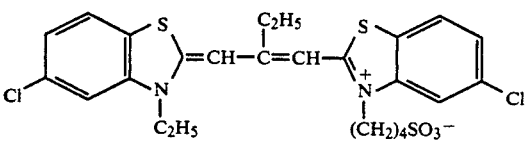

(V-58)

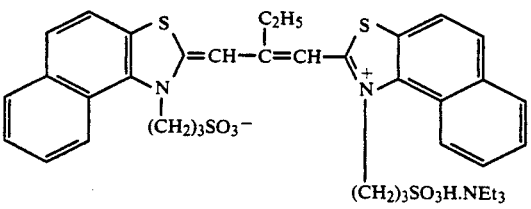

(V-59)

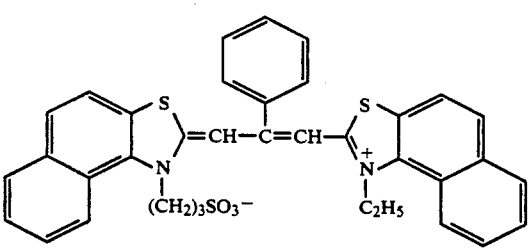

It is possible to incorporate 5- to 6-membered ring nuclei such as the pyrazolin-5-one nucleus, thiohydantoin nucleus, 2-thiooxazolidine-2,4-dione nucleus, thiazolidine -2,4-dione nucleus, rhodanine nucleus, thiobarbituric acid nucleus etc. as nuclei having ketomethylene structure in the merocyanine dye or compound merocyanine dye.

In the present invention, it is also possible to use spectral sensitizing dyes apart from those given above which include a pyrroline nucleus, oxazoline nucleus, thiazoline nucleus, pyrrole nucleus, thiazole nucleus, oxazole nucleus, selenazole nucleus, imidazole nucleus, tetrazole nucleus, pyridine nucleus, and nuclei in which alicyclic hydrocarbon rings or aromatic hydrocarbon rings have been fused in these or other such nuclei.

The substances disclosed in, for example, West German Patent No. 929,080, U.S. Pat. Nos. 2,231,658, 2,493,748, 2,503,776, 2,519,001, 2,912,329, 3,656,959, 3,672,897, 3,694,217, 4,025,349, 4,046,572; British Patent No. 1,242,588 and in JP-B-44-14030, 52-24822 etc. can be used as spectral sensitizing dyes in the present invention. (The term "JP-B" as used herein means an "examined Japanese patent publication".)

In the present invention, of the above dyes, those having a benzothiazole nucleus or a benzoxazole nucleus are preferred and simple cyanine dyes having a benzothiazole nucleus, carbocyanine dyes having a benzoxazole nucleus and dicarbocyanine dyes having a benzothiazole nucleus are particularly preferred.

Normally, when spectrally sensitizing the silver halide emulsion, the spectrally sensitizing dye is adsorbed onto the surface of the grain after the grain has been completely formed. In contrast, a method of adding a merocyanine dye during the sedimentation formation of the silver halide grains is disclosed in U.S. Pat. No. 2,735,766 wherein the amount of unadsorbed dye is reduced. Furthermore, JP-A-55-26589 discloses an aqueous silver salt solution for forming silver halide crystal grains and a method of adsorbing the spectral sensitizing dye by its addition during the addition of an aqueous halogen salt solution. Thus, the addition of the spectral sensitizing dye may take place during the formation of the silver halide crystal grains, after the completion of their formation or before the start of their formation. Specifically, "before the start of formation" means first introducing the spectral sensitizing dye into the reaction vessel before the start of the silver halide crystal forming reaction, "during grain formation" refers to processes such as those described in the aforementioned patents and "after the completion of grain formation" means adding and adsorbing of the sensitizing dye after the essential grain forming process is completed. The silver halide emulsions of the present invention are chemically sensitized after the completion of grain formation although the addition of the spectral sensitizing agents after the completion of grain formation can take place before the start of chemical sensitization, during chemical sensitization, after the completion of chemical sensitization or when applying the emulsion coat. Addition of the above spectral sensitizing dye in the present invention is preferably effected by adding and adsorbing the dye in at least one process at any stage following completion of the silver halide grain formation. The special sensitizing dye can be added in portions or over two or more operations. Furthermore, the spectral sensitizing dyes of the present invention may be added concentratedly over a short period of time and in one operation or they may be added continuously over a longer time period. Furthermore, a number of such addition operations may be combined.

The spectral sensitizing dyes may be added as a crystal or powder although, it is preferable that the dyes are first dissolved or dispersed. Water soluble solvents such as alcohols with from 1 to 3 carbon atoms, acetone, pyridine and methyl cellosolve or mixed solvents thereof may be used as a solvent. Furthermoe, it is also possible to make a micelle dispersion of the spectral sensitizing dye using a surfactant.

The amount of spectral sensitizing dyes added to the emulsion vaires with the purpose of spectral sensitization and the content of the silver halide emulsion. However, normally from $1\times10^{-6}$ mol to $1\times10^{-2}$ mol, and preferably from $1\times10^{-5}$ mol to $5\times10^{-3}$ mol per mol of silver halide is added.

The spectral sensitizing dyes used in the present invention may be used alone, although two or more kinds may also be used in combination. In addition to spectral sensitizing dyes, dyes which do not themselves have a spectral sensitizing action or supersensitizing agents, which strengthen the sensitizing action of the spectral sensitizing dye but which have essentially no absorption in the visible range, may also be included.

In the present invention, aminostilbene-based compounds substituted with a nitrogen-containing heterocyclic group (for example, the substances described in U.S. Pat. Nos. 2,933,390 and 3,635,721) are useful for (a) residual color reduction in the aforementioned carbocyanine dyes having an oxazole nucleus and for (b) improving the color sensitivity of dicarbocyanine dyes having a benzothiazole nucleus or benzoxazole nucleus. Their conjoint use is particularly preferred. Furthermore, azaindene compounds and hydroxyazaindene compounds in particular, are preferred for improving the color sensitivity.

Aminostilbene compounds used preferably in the present invention include; 4,4'-bis(s-triazinylamino)stilbene-2,2'-disulfonic acid 4,4'bis(pyrimidinylamino)stilbene-2,2'-disulfonic acid and their alkali metal salts etc. With these compounds, it is further preferable that the s-triazine ring or the pyrimidine ring is substituted in one or two locations by substituted or unsubstituted arylamino groups, substituted or unsubstituted alkylamino groups, substituted or unsubstituted aryloxy groups, substituted or unsubstituted alkyloxy groups or hydroxyl groups or amino groups etc. It is more preferable that the s-triazine or pyrimidine ring are substitued with a highly water-soluble substituent group for residual color reduction. Highly water-soluble substituent groups are those containing, for example, a sulfonate group or a hydroxyl group.

The spectral sensitizing dyes for use in the present invention may be represented by the general formula (F) below.

General formula (F)

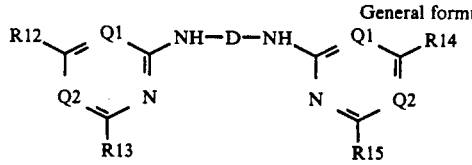

In the formula (F), D represents a divalent aromatic residual group, and R12, R13, R14 and R15 each represent a hydrogen atom, hydroxy group, alkoxy group, aryloxy group, halogen atom, heterocyclic group, mercapto group, alkylthio group, arylthio group, heterocyclic thio group, amino group, alkylamino group, cyclohexylamino group, arylamino group, heterocyclic amino group, aralkylamino group or aryl group.

Q1 and Q2 each denote —N= or —C=. However, at least one of Q1 and Q2 must be —N=.

Examples of preferred compounds for use in the present invention are given below.

(F-1)
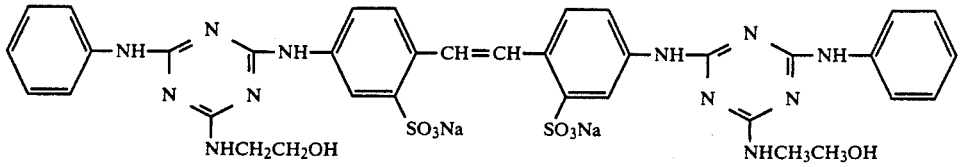
(F-2)
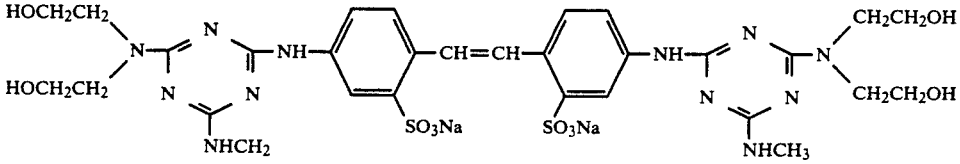
(F-3)
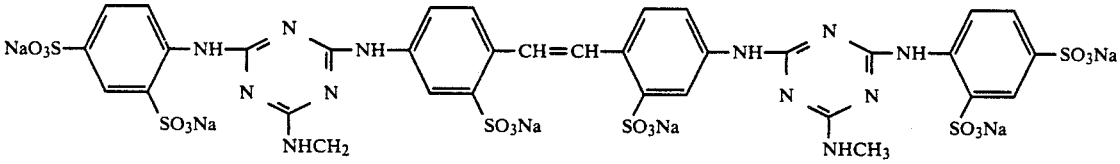
(F-4)
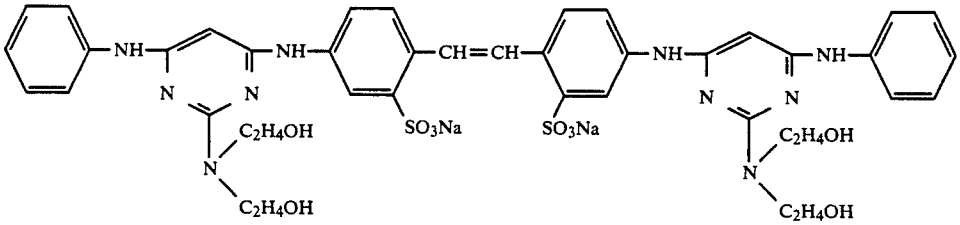
(F-5)
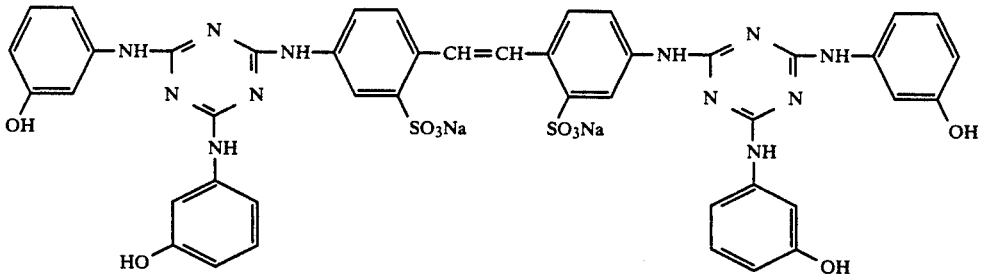
(F-6)
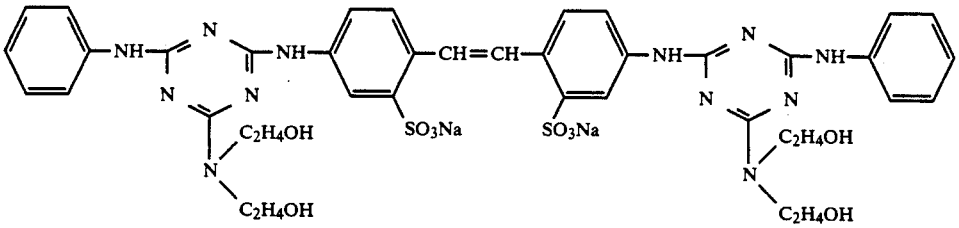

-continued
(F-7)
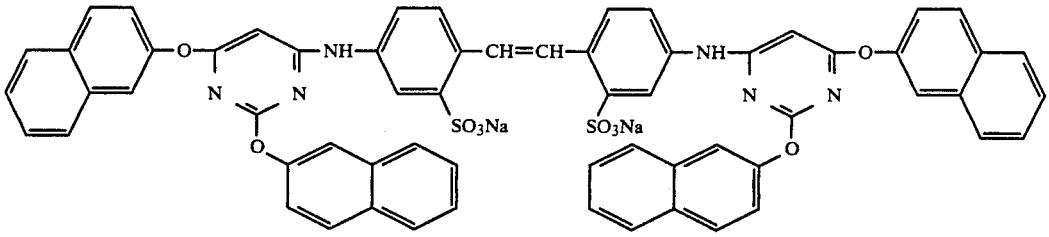
(F-8)
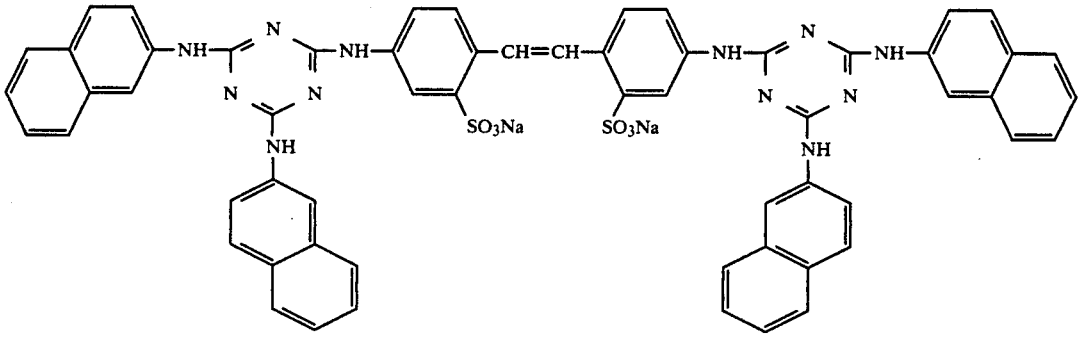
(F-9)
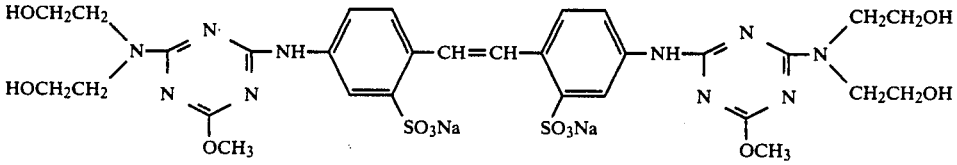
(F-10)
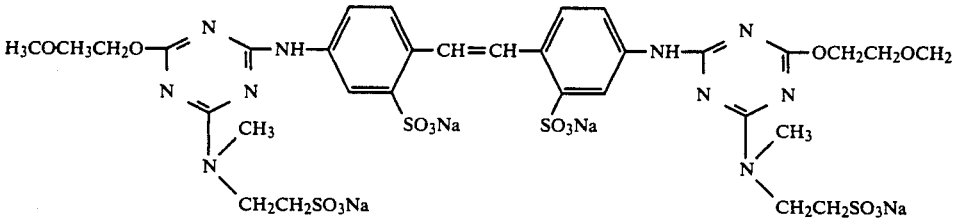
(F-11)
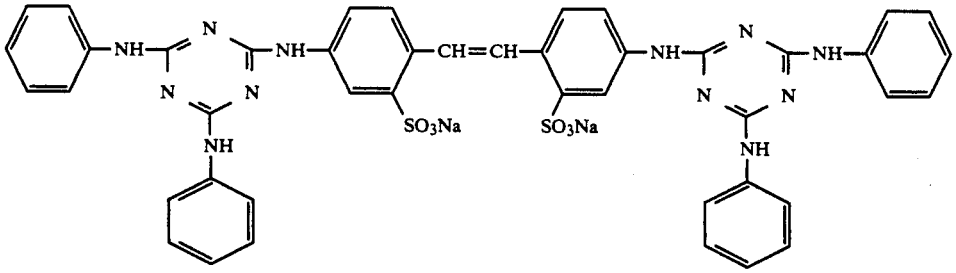
(F-12)
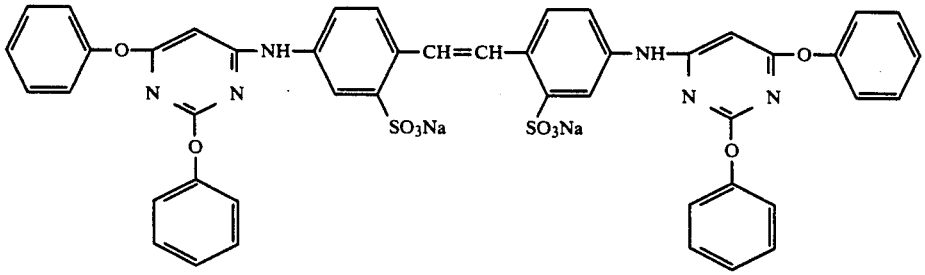

-continued
(F-13)
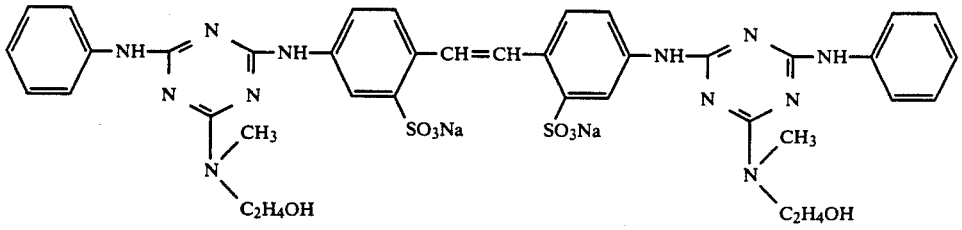
(F-14)
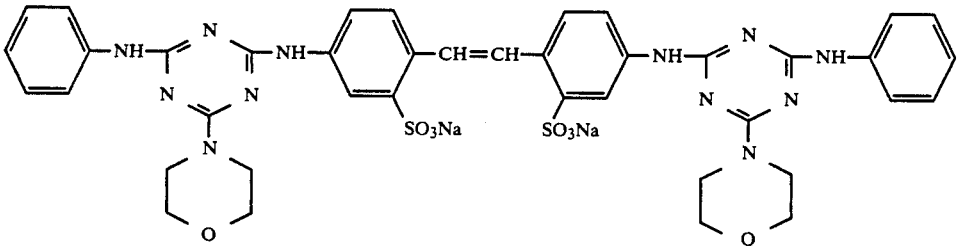
(F-15)
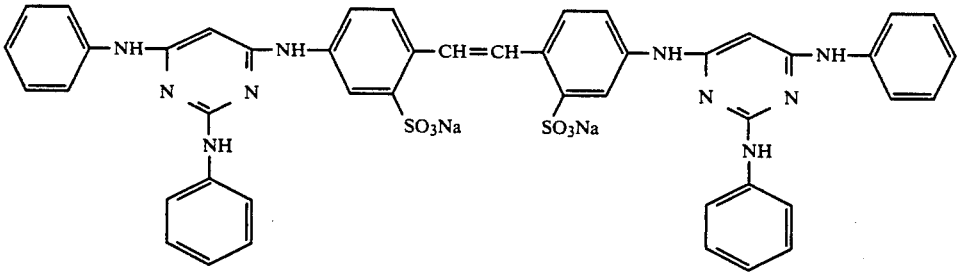
(F-16)
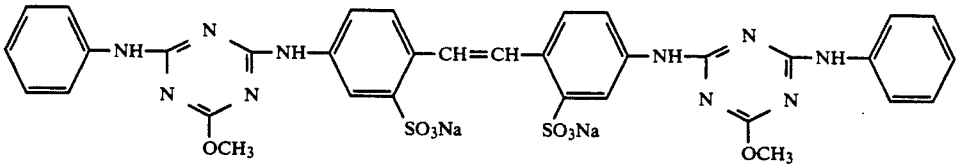
(F-17)
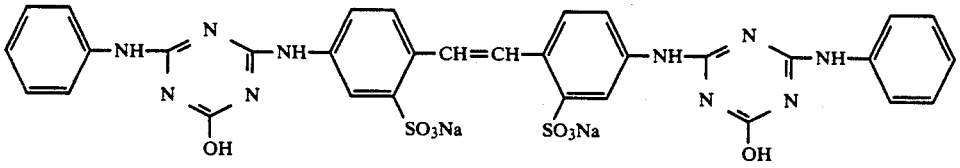
(F-18)
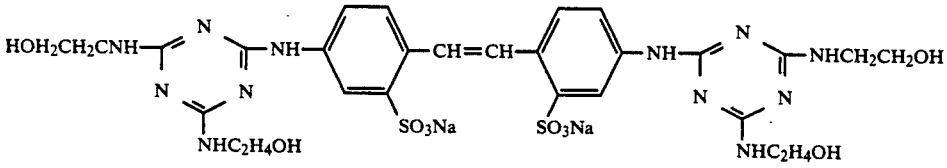

-continued (F-19)

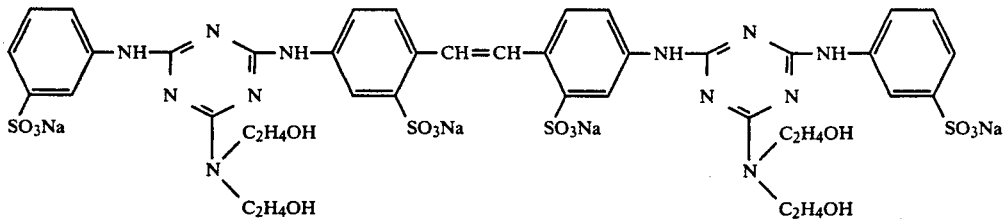

(F-20)

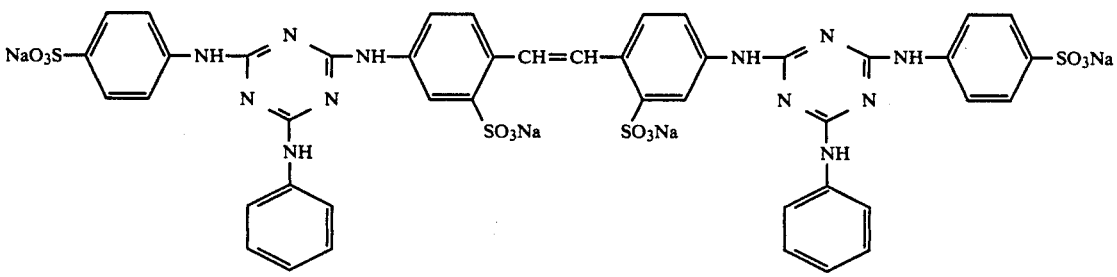

(F-21)

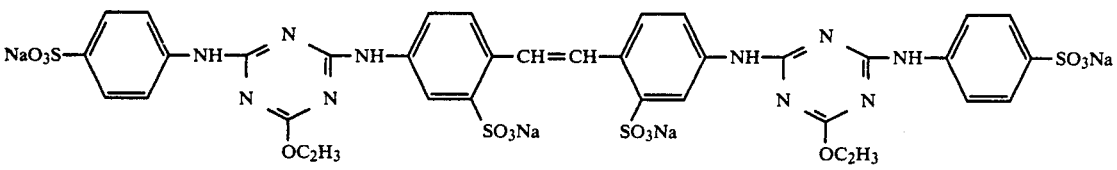

(F-22)

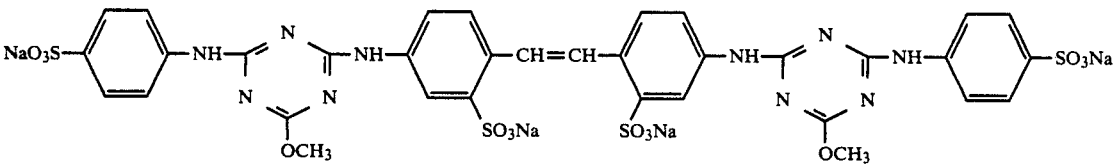

(F-23)

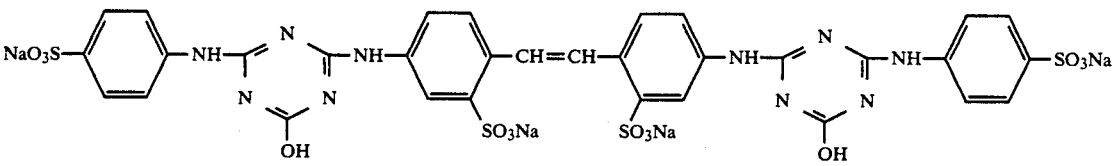

(F-24)

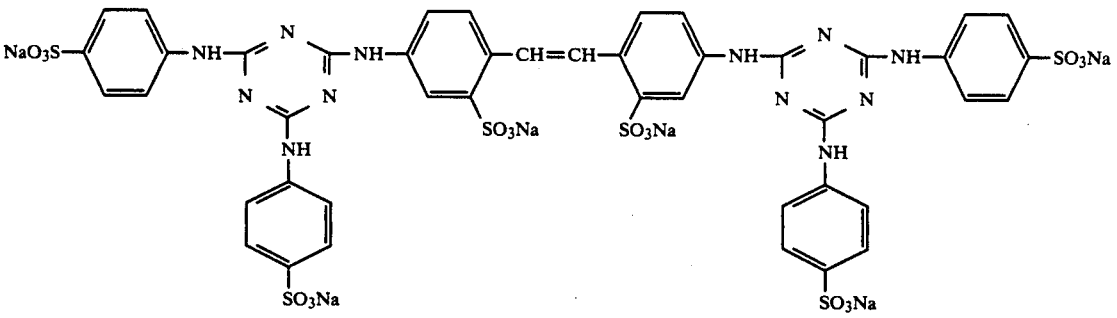

Compounds which follow are incorporated into the silver halide emulsions of the present invention in order to raise photographic stability and to prevent fogging during storage from the initial production of the photographic material until an initiation of development processing or during development processing. These additives include heterocyclic mercapto compounds (i.e. mercaptothiadiazoles, mercaptotetrazoles, mercaptobenzimidazoles, mercaptobenzothiazoles, mercaptopyrimidines, mercaptothiazoles etc.); heterocyclic mercapto compounds having a water soluble group such as a carboxyl group or sulfo group; azoles, including benzothiazolium salts, nitroindazoles, triazoles, benzotriazoles, and benzimidazoles (in particular, nitro substituted or halogen substituted); thioketo compounds (i.e., oxazolidinethione etc.); azaindenes including tetraazaindenes, etc.; and also benzene thiosulfinates, benzene sulfinates etc. The heterocyclic mercapto compounds and azaindenes are particularly preferred for use in the present invention.

Preferred azaindenes can be selected from the compounds represented by general formula (IIIa) or (IIIb) below.

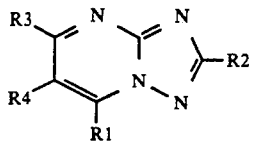

General formula (IIIa)

In formula (IIIa), R1, R2, R3 and R4 may each be the same or difference and represent a hydroxyl group, alkyl group, alkenyl group, aryl group, cyano group, ureido group, amino group, halogen atom or hydrogen atom and include 1 or 2 hydroxyl group(s).

The above alkyl group, alkenyl group, aryl group, ureido group and amino group have the same scope as provided for general formula (Ia) given below. Particularly preferred substituents of the alkyl group are an aryl group, alkoxycarbonyl group, carbomoyl group, cyano group, amino group and sulfonamido group etc.

Furthermore, R3 and R4 may join together to form a saturated or unsaturated 5- or 6-membered ring.

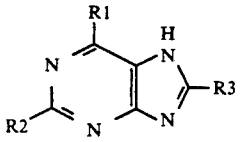

General formula (IIIb)

In formula (IIIb), R1, R2 and R3 each represents the same groups as R1 and R2 in general formula (IIIa) although, unlike general formula (IIIa), there is no need for at least one of R1 or R2 to be a hydroxyl group.

Specific examples compounds having general strucutre (IIIa) or (IIIb) for use in the present invention include:

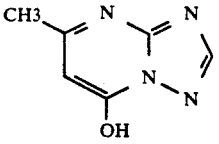

(III-1)

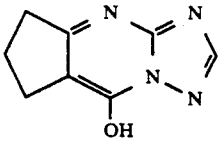

(III-2)

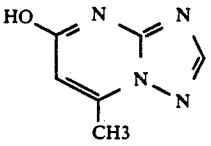

(III-3)

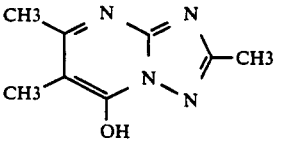

(III-4)

-continued

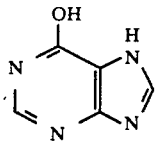

(III-5)

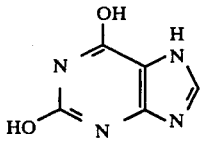

(III-6)

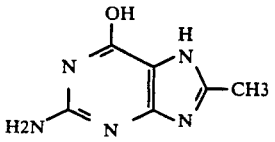

(III-7)

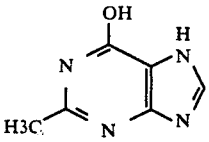

(III-8)

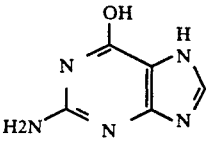

(III-9)

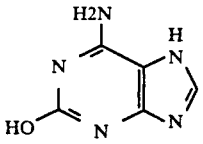

(III-10)

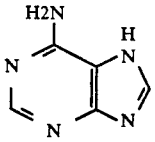

(III-11)

Preferred mercaptotetrazole-based compounds for use in the present invention can be selected from the compounds represented by general formula (Ia) below.

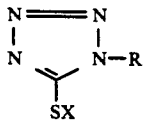

General formula (Ia)

In formula (Ia), R represents an alkyl group, alkenyl group, or aryl group. X represents a hydrogen atom, an alkali metal atom, an ammonium group or precursor. The alkali metal atom is, for example, a sodium atom, potassium atom etc., and the ammonium group is, for example, a trimethylammonium chloride group, dimethylbenzylammonium chloride group etc. Furthermore, the precursor is a group which is able to form X=H or an alkali metal under alkaline conditions and, for example, represents an acetyl group, cyanoethyl group, methanesulfonylethyl group etc.

Of the aforementioned R's, the alkyl group and the alkenyl group include unsubstituted and substituted forms and also include alicyclic groups. Examples of substituent groups of the substituted alkyl group include; a halogen atom, alkoxy group, aryl group, acylamino group, alkoxycarbonylamino group, ureido group, hydroxyl group, amino group, heterocyclic group, acyl group, sulfamoyl group, sulfonamido group, thioureido group, carbamoyl group, and also carboxyl group, sulfonyl group and salts thereof etc.

The above-mentioned ureido group, thioureido group, sulfamoyl group, carbamoyl group and amino group each may include unsubstituted, N-alkyl substituted and N-aryl substituted groups. Examples of the aryl group include phenyl and substituted phenyl groups. Examples of substituent groups include the alkyl group and the above substituents of the alkyl group etc.

Furthermore, preferred mercaptothiadiazole compounds can be selected from the compounds represented by general formula (IIa) below.

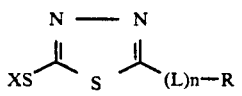

General formula (IIa)

In formula (IIa), L represents a divalent linking group, and R represents a hydrogen atom, alkyl group, alkenyl group or aryl group. X and the alkyl group and alkenyl group for R represent the same groups as given in general formula (Ia).

As specific examples of the divalent linking group represented by L include;

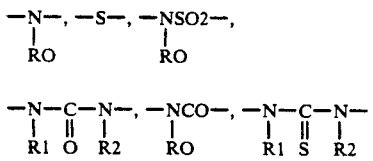

n represents the integer 0 or 1, and R0, R1 and R2 each represent a hydrogen atom, alkyl group or aralkyl group. Specific examples of these compounds are given as follows.

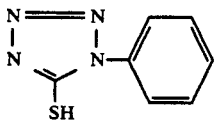

(I-1)

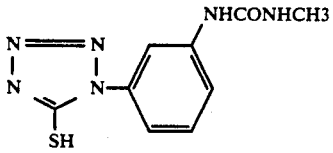

(I-2)

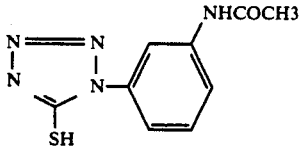

(I-3)

-continued

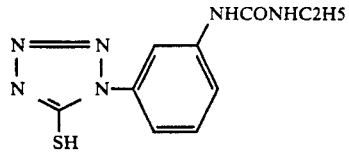

(I-4)

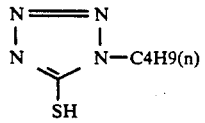

(I-5)

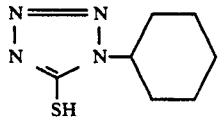

(I-6)

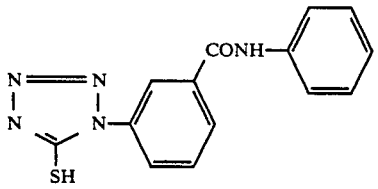

(I-7)

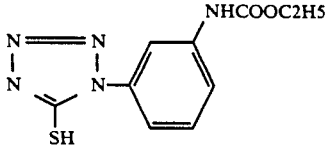

(I-8)

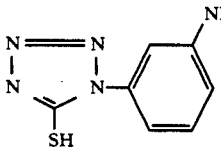

(I-9)

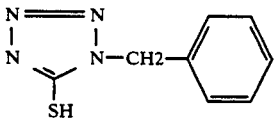

(I-10)

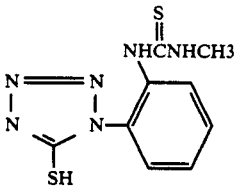

(I-11)

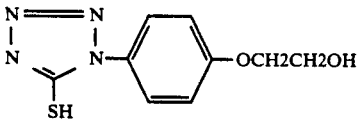

(I-12)

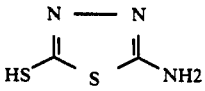

(II-1)

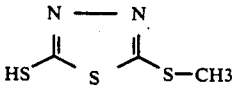

(II-2)

-continued

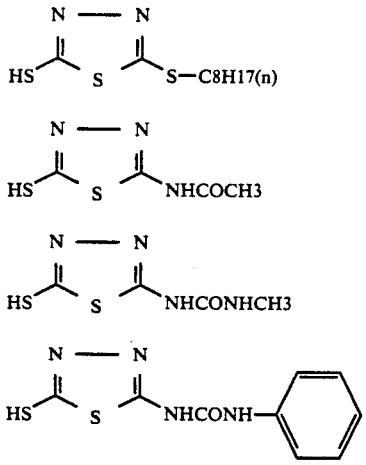

In the present invention, in order to prevent irradiation during exposure or printing and to raise the stability safe light, to use of dyes are particularly preferred, such as those shown below, which do not reduce the speed or impair the latent image storage properties, which do not adversely effect other photographic properties and which do not leave residual color after processing.

Apart from the pyrazoloneoxonol dyes, other dyes such as anthraquinone-based dyes may also be used.

The compounds represented by the general formula (D) below are preferably used as pyrazoloneoxonol dyes.

General formula (D)

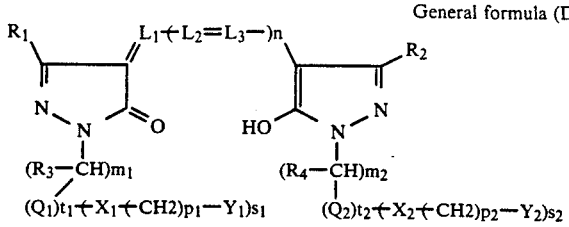

In the formula (D), R1 and R2 respectively represent —COOR5 or

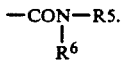

R3 and R4 respectively represent a hydrogen atom, alkyl group or substituted alkyl group (for example, methyl group, ethyl group, butyl group, hydroxyethyl group etc.), and R5 and R6 each represent a hydrogen atom, alkyl group or substituted alkyl group (for example, methyl group, ethyl group, butyl group, hydroxyethyl group, phenethyl group etc.), aryl group or substituted aryl group (for example, phenyl group, hydroxyphenyl group etc.). Q1 and Q2 each represent an aryl group (for example, phenyl group, naphthyl group etc.). X1 and X2 represent a bonded or divalent linking group, and Y1 and Y2 each represent a sulfonic group or carboxyl group. L1, L2 and L3 each represent a methine group. m1 and m2 represent each 0, 1 or 2; n represents the integers 0, 1 or 2, p1 and p2 each represent the integers 0, 1, 2, 3 or 4, s1 and s2 each represent the integers 1 or 2; and t1 and t2 each represent the integers 0 or 1. However, m1, p1 and t1, and m2, p2 and t2 can not all be 0.

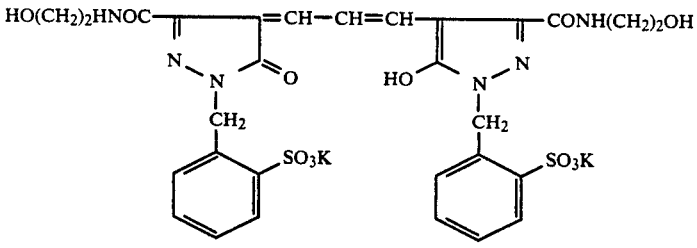

(D-1)

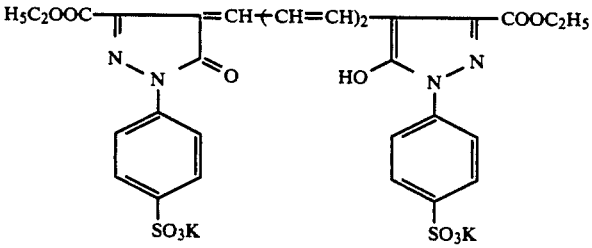

(D-2)

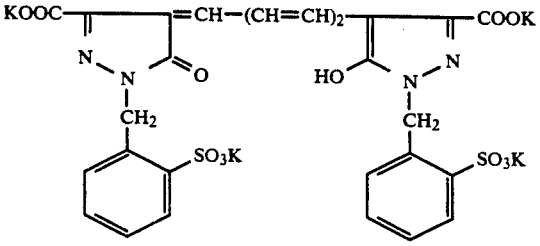

(D-3)

-continued

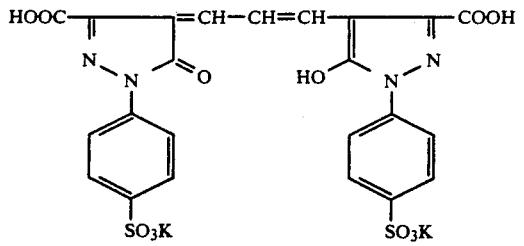

(D-4)

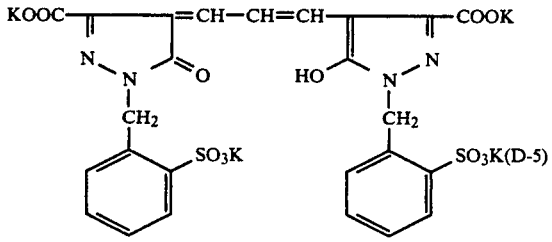

(D-5)

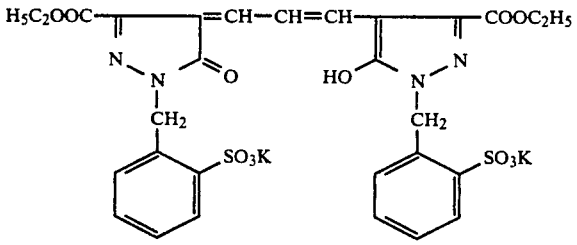

(D-6)

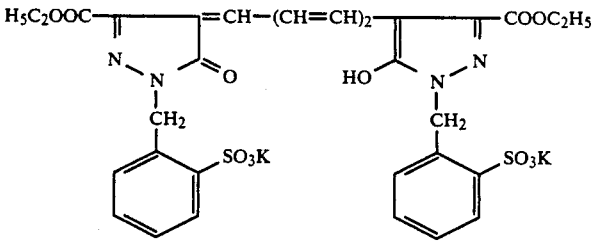

(D-7)

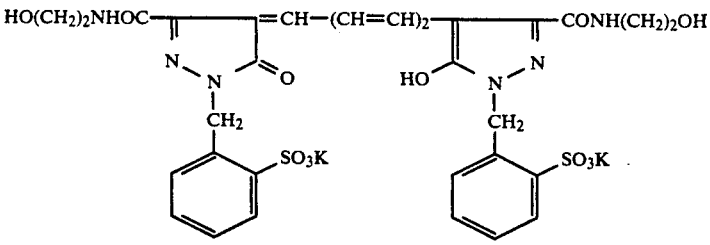

(D-8)

The silver halide photographic emulsions of the present invention can be used together with color couplers such as cyan couplers, magenta couplers and yellow couplers and coupler-dispersing compounds. It is preferable that these couplers are rendered fast to diffusion by polymerization or by including a ballast group. Use of two equivalent color couplers substituted with an elimination group requires less coated silver than and is preferred to four equivalent color couplers in which hydrogen is at the active coupling position. It is also possible to use couplers in which the colored dye has a suitable degree of diffusibility, colorless couplers and DIR couplers which release development inhibitors or couplers which release development accelerators during the coupling reaction.

Acylacetamide-based couplers of the oil protect type may be given as representative examples of yellow couplers which can be used in this invention. Specific examples of these are disclosed in U.S. Pat. Nos. 2,407,210, 2,875,057 and 3,265,506. In this invention, the use of two equivalent yellow couplers is preferred and the oxygen atom elimination type yellow couplers disclosed in U.S. Pat. Nos. 3,408,194, 3,447,928, 3,933,501 and 4,022,620 etc. or the nitrogen atom elimination type yellow couplers disclosed in Japanese Patent Document No. 10,739/83, U.S. Pat. Nos. 4,401,752, 4,326,024, RD18053 (April 1979), British Patent No. 1,425,020, West German Laid Open Applications No. 2,219,917, No. 2,261,361, No. 2,329,587 and No. 2,433,812 etc. are representative examples. α-privaloylacetanilido-based couplers are excellent in terms of the fastness of the colored dye, in particular light fastness, and are used preferably. Moreover, α-benzoylacetanilido-based couplers are used preferably in order to achieve a high color density.

Oil protect type indazolone-based or cyanoacetyl-based couplers, and preferably 5-pyrazolone-based couplers and couplers based on pyrazoloazoles such as pyrazolotriazole are preferably used for as magenta couplers in the present invention. With respect to the 5-pyrazolone-based couplers, these couplers which have been substituted in the 3-position by an arylamino group or an acylamino group are preferred in view of the hue of the colored dye and the color density. Representative examples of these couplers are disclosed in U.S. Pat. Nos. 2,311,082, 2,343,703, 2,600,788, 2,908,573, 3,062,653, 3,152,896 and 3,936,015 etc. As an elimination group of two equivalent 5-pyrazolone-based couplers, the nitrogen atom elimination groups disclosed in U.S. Pat. No. 4,310,619 or the arylthio groups disclosed in U.S. Pat. No. 4,351,897 are preferred. Furthermore, a high color density is obtained with the 5-pyrazolone-based couplers having a ballast group disclosed in European Patent No. 73,636 and this is preferred.

The pyrazolobenzimidazoles disclosed in U.S. Pat. No. 3,369,879 and preferably the pyrazolo[5,1-c][1,2,4]triazoles disclosed in U.S. Pat. No. 3,725,067, the pyrazolotetrazoles disclosed in Research Disclosure 24220 (June 1984) and the pyrazolopyrazoles disclosed in Research Disclosure 24230 (June 1984) are examples of pyrazoloazole-based couplers for use in the present invention. The imidazo[1,2-b]pyrazoles disclosed in European Patent No. 119,741 are preferred, and the pyrazolo[1,5-b][1,2,4]triazoles disclosed in European Patent No. 119,860 are particularly preferred on account of the low secondary yellow absorption and the light fastness of the colored dye.

Cyan couplers for in the present invention include naphthol-based couplers and phenol-based couplers of the oil protect type. The naphthol-based coupler disclosed in U.S. Pat. No. 2,474,293, and preferably the two equivalent naphthol-based couplers with an oxygen atom elimination group disclosed in U.S. Pat. Nos. 4,052,212, 4,146,396, 4,228,233 and 4,296,200 are given as representative examples. Furthermore, specific examples of phenol-based couplers are disclosed in U.S. Pat. Nos. 2,369,929, 2,801,171, 2,772,162, 2,895,826 etc. Cyan couplers which are fast to humidity and temperature are preferred for use in the present invention and include, for example, the phenol-based cyan couplers having an ethyl or higher alkyl group in the meta position of the phenol nucleus as disclosed in U.S. Pat. No. 3,772,002, the 2,5-diacylamino-substituted phenol-based couplers mentioned in U.S. Pat. Nos. 2,772,162, 3,758,308, 4,126,396, 4,334,011, 4,327,173, West German Laid Open Patent No. 3,329,729 and Japanese Patent Application No. 42,671/83 etc. and the phenol-based couplers having a phenylureido group in the 2-position and an acylamino group n the 5-position disclosed in U.S. Pat. Nos. 3,446,622, 4,333,999 4,451,559 and 4,427,767 etc. and other such cyan couplers.

It is possible to improve the graininess by conjointly using a coupler in which the colored dye has an appropriate degree of diffusibility. Specific examples of diffusible magenta couplers are disclosed in U.S. Pat. No. 4,366,237 and in British Patent No. 2,125,570 and specific examples of diffusible yellow, magenta or cyan couplers are disclosed in European Patent No. 96,570 and West German Laid Open Application No. 3,234,533.

The dye-forming couplers and the special couplers described above may be used in the form of dimers or higher polymers. Typical examples of dye-forming couplers which have been polymerized are disclosed in U.S. Pat. Nos. 3,451,820 and 4,080,211. Specific examples of polymerized magenta couplers are disclosed in British Patent No. 2,102,173 and U.S. Pat. No. 4,367,282.

Two or more types of the various couplers for use in the present invention may be incorporated into the same photosensitive layer in order to satisfy the properties required of the photosensitive material. It is also possible to introduce an identical coupler into two or more different layers.

The amount of color coupler used in the present invention is within the range of from 0.001 to 1 mol per mol of photosensitive silver halide; preferably, it is from 0.01 to 0.5 mol per mol for the yellow coupler, from 0.003 to 0.5 mol per mol for the magenta coupler and from 0.002 to 0.5 mol per mol for the cyan coupler.

The photosensitive materials produced according to the present invention may contain hydroquinone derivatives, aminophenol derivatives, amines, gallic acid, catechol derivatives, ascorbic acid derivatives, colorless couplers and sulfonamidophenol derivatives as anti-color fogging agents or anti-color mixing agents.

Anti-color fading agents can be used in the photosensitive material of the present invention including hydroquinones, 6-hydroxychromanes, 5-hydroxycoumarans, spirochromanes, p-alkoxyphenols and hindered phenols, notably bisphenols, gallic acid derivatives, methylenedioxybenzenes, aminophenols, hindered amines and silylated or alkylated ether or ester derivatives of the phenolic hydroxyl groups of these various compounds. Acrylate-based polymers and acrylamide-based polymers, for example, polymers with a high molecular weight as represented by poly(methyl methacrylate) and poly(t-butylacrylamide) etc., are also effective as anti-color fading agents; they are preferably used for the yellow and cyan dyes. Furthermore, it is also possible to use metal complexes represented by the (bis-salicylaldoximato)nickel complex and the (bis-N,N-dialkyldithiocarbamato)nickel complex.

Compounds having the dual structure of a hindered amine and a hindered phenol within the same molecule such as those described in U.S. Pat. No. 4,268,593 effectively prevent the deterioratinn of the yellow dye image due to heat, humidity and light. Furthermore, the spiroindans disclosed in Japanese Patent Application (OPI) No. 159,644/81 and the hydroquinone diether- or monoether-substituted chromanes disclosed in Japanese Patent Application (OPI) No. 89,835/80 effectively prevent the deterioration of the magenta dye image, in particular due to light.

The combined use of a benzotriazole-based ultraviolet absorber is preferred for improving the storage properties of the cyan image, and in particular the fastness to light. This ultraviolet absorber may be emulsified together with the cyan coupler.

The coated amount of the ultraviolet absorber may be an amount sufficient to impart light stability to the cyan dye image and, since the use of an excessive amount would bring about a yellowing in the unexposed part (the white base) of the color photographic material, its use is normally preferred in the range from $1\times10^{-4}$ mol/m$^2$ to $2\times10^{-3}$ mol/m$^2$ and particularly preferred within the range $5\times10^{-4}$ mol/m$^2$ to $1.5\times10^{-3}$ mol/m$^2$.

In the present invention, it is preferable to use the following compounds in conjunction with the aforementioned couplers and in particular in conjunction with the pyrazoloazole couplers.

Thus, in order, for example, to prevent the development of stains and other such side effects due to colored dye, the color developing agent or its oxidized form remaining in the film during storage after processing, it is preferable to use, either simultaneously or singly; compound (A), given below, which bonds chemically with aromatic amine-based developing agents remaining after color development processing to form chemically inert and essentially colorless compounds; and/or compound (B), which bonds chemically with the oxidized forms of aromatic amine-based color developing agents remaining after color development processing to form chemically inert and essentially colorless compounds.

Preferred compounds of type (A) are those whose second-order reaction rate constant $k^2$ with p-anisidine (in trioctylphosphate at 80° C.) is within the range of from 1.0 1/mol. sec to $1\times10^{-5}$ 1/mol. sec.

When $k^2$ exceeds this range, the compound itself becomes unstable and reacts with gelatin or water, thus decomposing. On the other hand, when $k^2$ is below this range, the reaction with the remaining aromatic amine-based developing agents is slow and does not prevent the side effects of the remaining aromatic amine-based developing agents which is an objective of this invention.

The preferred substances for such a compound (A) can be represented by the general formula (AI) or (AII) below.

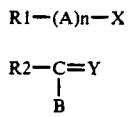

General formula (AI)

General formula (AII)

In formulae (AI) and (AII), R1 and R2 each represent aliphatic groups, aromatic groups or heterocyclic groups. n represents the integer 1 or 0. B represents a hydrogen atom, aliphatic group, aromatic group, heterocyclic group, acyl group or sulfonyl group, and Y represents a group which promotes the addition of aromatic amine-based developing agents onto compounds of general formula (AII). Here, R1 and X and Y and R2 or B may bond together to form a cyclic structure.

Typical mechanisms for bonding the remaining aromatic amine-based developing agent include substitution reactions and addition reactions.

Various groups for the compounds represented by general formulae (AI) and (AII) are given in detail below.

The aliphatic groups in R1 , R2 and B represent a linear, branched or cyclic alkyl group, alkenyl group or alkynyl group. These groups may also be substituted. The aromatic groups in R1 , R2 and B may be any of the carbocyclic aromatic groups (for example, phenyl group, naphthyl group etc.) and heterocyclic aromatic groups (for example, furyl, thienyl groups, pyrazolyl group, pyridyl group, indolyl group etc.); and may be single ringed or condensed ringed (for example benzofuryl groups, phenanthridinyl group etc.). Furthermore, these aromatic rings may be substitued.

The hereto rings in R1 , R2 and B are preferably groups with a 3- to 10-membered cyclic structure formed from carbon atoms, oxygen atoms, nitrogen atoms, sulfur atoms or hydrogen atoms. The hetero ring itself may be saturated or substituted with, for example, a coumanyl group, pyrrolidyl group, pyrrolinyl group, or morpholinyl group etc.

X represents a group which is eliminated by reacting with aromatic amine-based developing agents, and is preferably a group that bonds with A via an oxygen atom, sulfur atom or nitrogen atom (for example, 3-pyrazolyloxy group, 3H-1,2,4-oxadiazoline-5-oxy group, aryloxy group, alkoxy group, alkylthio group, arylthio group, substituted N-oxy group etc.) or a halogen atom.

A represents a group which forms a chemical bond by reacting with aromatic amine-based developing agents and includes groups containing an atom of a low electron density;

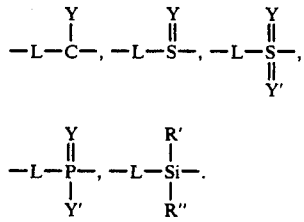

When X represents a halogen atom, n represents 0. Here, L represents a single bond, alkylene group,

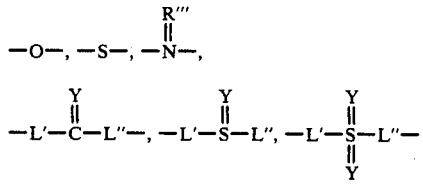

(for example, carbonyl group, sulfonyl group, sulfinyl group, oxycarbonyl group, phosphonyl group, thio-carbonyl group, aminocarbonyl group, silyloxy group etc.)

Y has the same meaning as Y in general formula (AII) and Y' has the same meaning as Y.

R' and R" may be identical or different and each represents —L'''-$R_0$.

Ro has the same meaning as R1. R''' represents a hydrogen atom, aliphatic group (for example, methyl group, isobutyl group, t-butyl group, vinyl group, benzyl group octadecyl group, cyclohexyl group etc.), aromatic group (for example, phenyl group, pyridyl group, naphthyl group etc.) hetero ring (for example, piperidinyl group, pyranyl group, group, chromanyl group etc.), acyl group (for example, acetyl group, benzyl group etc.) or sulfonyl group (for example, methanesulfonyl group, benzenesulfonyl group etc.) L', L", L''' each represent

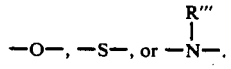

Of these, A is preferably a divalent group represented by

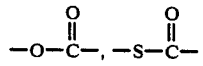

and $$-\text{alkenylene-}\overset{\overset{\displaystyle O}{\|}}{C}-;$$

Y in general formula (AII) is preferably an oxygen atom, sulfur atom, $=N-R_4$ or $$=\overset{\overset{\displaystyle R_5}{|}}{C}=R_6$$

Here, R4, R5 and R6 each represent a hydrogen atom, aliphatic group (for example, methyl group, isopropyl group, t-butyl group, vinyl group, benzyl group, octadecyl group, cyclohexyl group etc.), aromatic group (for example, phenyl group, pyridyl group, naphthyl group etc.), heterocyclic group (for example, piperidyl group, pyranyl group, furanyl group, chromanyl group etc.), acyl groups (for example, acetyl group, benzoyl group etc.) or sulfonyl groups (for example, methanesulfonyl group, benzenefulfonyl group etc.) R5 and R6 may bond together to form a cyclic structure.

The details of the compounds represented by general formulae (AI) and (AII) are disclosed in JP-A-63-158545 and 62-283338, and EP-A-0277589 (The term "EP-A" as used herein means an "unexamined published European Patent Application".)

Preferred substances for compound (B), which bond chemically with the oxidized forms of aromatic amine based developing agents after color development processing to form essentially colorless compounds, are compounds having a nucleophilic group derived from nucleophilic functional groups with a Pearson nucleophilicity nCH3I value (R. G. Person, et al., J. Am. Chem. Soc., 90, 319 (1968)) of not less than 5.

Preferred substances for compound (B) are represented by the general formula (B') below.

General formula (B') R7—Z.M

In formula (B'), R7 represents an aliphatic group, aromatic group or heterocyclic group. Z represents a nucleophilic group. M represents a hydrogen atom, metal cation, ammonium cation or protective group.

The various groups represented in general formula (B') are described in further detail below, which are also disclosed in JP-A-62-143048 and 62-229145, and EP-A-255722 and 277589.

The aliphatic groups represented by R7 include a substituted or unsubstituted linear or cyclic alkyl group, alkenyl group or alkynyl group. The aromatic group represented by R7 may be any of the carbocyclic aromatic groups (for example, phenyl group, naphthyl group etc.) and heterocyclic aromatic groups (for example, furyl group, thienyl group, pyrazolyl group, pyridyl group, indolyl group etc.). The R7 aromatic group may be single ringed or condensed ringed (for example, benzofuryl group, phenanthridinyl group etc.). Furthermore, the aromatic rings may be substituted.

The heterocyclic groups of R7 are preferably groups with a 3- to 10-membered cyclic structure formed from carbon atoms, oxygen atoms, nitrogen atoms, sulfur atoms or hydrogen atoms. The hetero ring itself may be saturated or unsaturated and may be substituted by for example a coumanyl group, pyrrolidyl group, pyrrolinyl group or morpholinyl group etc.).

Z represents a nucleophilic group in which the atom forming a direct chemical bond with the oxidized forms of aromatic amine-based developing agents is an oxygen atom, sulfur atom or nitrogen atom (for example, amine compounds, azide compounds, hydrazine compounds, mercapto compounds, sulfide compounds, sulfinate compounds, cyano compounds, thiocyano compounds, thiosulfate compounds, seleno compounds, halide compounds, carboxy compounds, hydroxamate compounds, active methylene compounds, phenol compounds, heterocyclic nitrogen compounds etc.)

M represents a hydrogen atom, metal cation, ammonium cation or protective group.

The compounds represented by general formula (B') undergo a nucleophilic reaction (typically a coupling reaction) with the oxidized forms of aromatic amine-based developing agents.

The most preferred compounds represented by general formula (B') are those represented by general formula (B'') below.

General formula (B'')

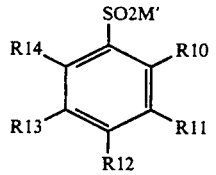

In formula (B''), M' represent an atom or atomic group forming inorganic (for example, Li, Na, K, Ca, Mg etc.) or organic (for example, triethylamine, methylamine, ammonia etc.) salts, $$-NHN=C\begin{matrix}R_{15}\\R_{16}\end{matrix},\ -\overset{\overset{\displaystyle R_{17}}{|}}{N}-\overset{\overset{\displaystyle R_{18}}{|}}{N}-SO_2R_{19},\ \text{or}\ -\overset{\overset{\displaystyle R_{20}}{|}}{N}-\overset{\overset{\displaystyle R_{21}}{|}}{N}-COR_{22}.$$

Here, R15 and R16 may be identical or different and each represents a hydrogen atom or aliphatic group, aromatic group or heterocyclic group with the same meaning as R1. R 15 and R16 may bond together to form a 5-to 7-membered ring. R17, R18, R20 and R21 are identical or different and each represents a hydrogen atom or aliphatic group, aromatic group or heterocyclic group having the same meaning as R7. R17, R18, R20 and R21 each also represent an acyl group, alkoxycarbonyl group, sulfonyl group, ureido group or urethane group. However, at least one of R17 and R18 and at least one of R20 and R21 is a hydrogen atom. R19 and R22 each represent a hydrogen atom or the same aliphatic groups, aromatic groups or heterocyclic groups as R17. Moreover, R22 represents an alkylamino group, arylamino group, alkoxy group, aryloxy group, acyl group, alkoxycarbonyl group or aryloxycarbonyl group etc. Here, at least two of the groups R17, R18 and R19 may be bond together to form a 5-to 7-membered ring and at least two of the groups R20, R21 and R22 may bond together to form a 5- to 7-membered ring.

R10, R11, R12, R13 and R14 are identical or different and each represents a hydrogen atom, aliphatic group, (for example, methyl group, isopropyl group, t-butyl butyl group, vinyl group, benzyl group, octadecyl group, cyclohexyl group etc.), aromatic group (for example, phenyl group, pyridyl group, naphthyl group etc.), heterocyclic group (for example, piperidyl group, pyranyl group, furanyl group, chromanyl group etc.), halogen atom (for example, chlorine atom, bromine atom etc.), —SR8, —OR8, $$-\underset{\underset{R9}{|}}{N}-R8,$$

group etc.), alkoxycarbonyl group (for example, methoxycarbonyl group, butoxycarbonyl group, cyclohexylcarbonyl group, octyloxycarbonyl group etc.), aryloxycarbonyl group (for example, phenyloxycarbonyl group, naphthyloxycarbonyl group etc.), sulfonyl group (for example, methane-sulfonyl group, benzenesulfonyl group etc.), sulfonamido group (for example, methanesulfonamido group, benzenesulfonamido group etc.), sulfamoyl group, ureido group, urethane group, carbamoyl group, sulfo group, carboxyl group, nitro group, cyano group, alkoxalyl group (for example, methoxalyl group, isobutoxalyl group, octyloxalyl group, benzoyloxalyl group etc.), aryloxalyl group (for example, phenoxalyl group, naphthoxalyl group etc.), sulfonyloxy group (for example, methanesulfonyloxy group, benzenesulfonyloxy group etc.), —P(R8)3, $$\overset{O}{\overset{\|}{P}}(R8)2,\ -\overset{S}{\overset{\|}{P}}(R8)2,$$

—P(OR8)3 or formyl group. Here, R8 and R9 each represent a hydrogen atom, aliphatic group, alkoxy group or aromatic group. Of these, compounds with a total Hammet δ value of no less than 0.5 with respect to —S02M′ are particularly preferred for use in this invention.

It is possible to use the various couplers described herein as dispersions by dissolving the couplers in high boiling point organic solvents. The high boiling point organic solvents used in the present invention are not miscible with water and have a boiling point of not less than 120° C. Those solvents which can be used for both the couplers and other additives described herein are preferred.

The melting point of the high boiling point organic solvents is preferably not more than 80° C. The boiling point of the high boiling point organic solvents is preferably not less than 140° C. and more preferably not less than 160° C.

The preferred amount of high boiling point organic solvent used to form a dispersion in the invention varies depending on the type and amount of couplers and other conjointly used compounds, although the high boiling point organic solvent to coupler ratio is preferably 0~20 and more preferably 0.01~10 by weight. Furthermore, it is possible to use high boiling point organic solvents in which, for example, the melting points and boiling points or the dielectric constant and refractive indices are completely different, either by mixing or individually.

In the present invention, emulsified dispersions of lipophilic fine grains containing couplers, high boiling point organic solvents and the aforementioned compounds are prepared as described below.

A polymer or a copolymer of the present invention (a linear polymer without cross-linking or a copolymer thereof dissolvable in a water-soluble high boiling point organic solvent as is disclosed in WO-88-00723, pages 12 to 30, or EP-$A_2$-280238 synthesized by the solution polymerization method, emulsion polymerization or suspension polymerization methods etc. Acrylamide polymer being most preferred in view of stabilization of color image), is first dissolved together with the high boiling point organic solvent and the couplers in an optional auxiliary organic solvent. This solution is then dispersed into a fine granular form using an ultrasonic, colloid mill or other mechanical dispersion method using a dispersing agent in water, preferably in a hydrophilic colloid solution and more preferably in an aqueous gelatin solution. Alternatively, an oil-in-water dispersion with phase reversal may be formed by adding an aqueous hydrophilic colloid solution of water or gelatin etc. in an auxiliary organic solvent containing a dispersing agent such as a surfactant, a polymer of the present invention, a high boiling point organic solvent and couplers. The auxiliary organic solvent may be removed from the prepared dispersion by distillation, noodle washing or ultrafiltration. In this context, an auxiliary organic solvent means a low boiling point organic solvent which can be eliminated by evaporation or a solvent which can be removed by water washing etc.. The auxiliary solvent is an organic solvent which is useful during emulsification dispersion, and which is ultimately essentially eliminated from the photosensitive materials by the drying operation during coating or by the above-mentioned methods etc. Auxiliary organic solvents include acetates such as ethyl acetate and butyl acetate, butyl "Carbitol" acetate, ethyl propionate, sec-butyl alcohol, methyl ethyl ketone, methyl isobutyl ketone, β-ethoxyethyl acetate, methyl "Cellosolve" acetate or cyclohexanone etc.

Furthermore, it is also possible to partly use organic solvents which are miscible with water conjointly, for example methyl alcohol, ethyl alcohol, acetone and tetrahydrofuran etc.

Two or more kinds of these organic solvents can be used in combination.

It is preferable that the average grain size of the hydrophilic fine grains obtained in this way is not less than 0.03μ and not more than 2μ. More preferably, the grain size is not less than 0.05∞ and not more than 0.4μ. The grain size of the lipophilic fine grains can be measured with equipment such as the Nanosizer manufactured by the Coal Tar Company.

Apart from silver halide emulsion layers, the photosensitive materials of the present invention are preferably suitably provided with protective layers, intermediate layers, filter layers, anti-halation layers, backing layers and other such auxiliary layers.

It is useful to use gelatin as the binder or protective colloid in the emulsion layers or intermediate layers of the photosensitive material of the present invention although it is possible to use other hydrophilic colloids as well.

For example, it is possible to use various synthetic hydrophilic polymeric substances such as gelatin derivatives, graft polymers of gelatin and other polymers, albumin, casein and suchlike proteins; hydroxyethylcellulose, carboxymethylcellulose, cellulose sulfate esters and suchlike cellulose derivatives, sodium alginate, starch derivatives and other such sugar derivatives; polyvinyl alcohol, polyvinyl alcoholpartially acetalated, poly-N-pyrrolidone, polyacrylate, polymethacrylate, polyacrylamide, polyvinyl-imidazole, polyvinyl-pyrazole and other such homo- or copolymers.

Apart from lime-treated gelatins, acid-treated gelatins and the enzyme treated gelatins described in the Bull. Soc. Sci. Phot. Japan, No. 16, page 30, 1966 may be used and it is also possible to use the hydrolysis products and enzyme decomposition products of gelatins.

Various other photographic additives can be included in the emulsion layers and auxiliary layers of the photosensitive materials according to the present invention. For example, where appropriate, it is possible to use the antifoggants, anti-color image fading agents, anti-color staining agents, brightening agents, antistatic agents, film hardening agents, surfactants, plasticizers, lubricants and ultraviolet absorbers etc. disclosed in Research Disclosure Journal No. 17643.

The silver halide photographic materials of the present invention are produced by coating various structural layers (i.e., emulsion layers and auxiliary layers containing various photographic additives as described above) onto a support which has undergone corona discharge treatment, flame treatment or ultraviolet irradiation treatment, or via an undercoating layer or intermediate layer onto a support. Supports for use in the present invention include, for example, baryta paper, polyethylene-coated paper, synthetic polypropylene paper provided with a reflective layer and transparent supports making joint use of reflective bodies, for example glass plates, cellulose acetate, cellulose nitrate or polyethylene terephthalate and other such polyester films, polyamide films, polycarbonate films, polystyrene films etc. These supports may be appropriately selected according to the intended use of the individual photosensitive material.

Various coating methods such as dipping coating, air-doctor coating, curtain coating and hopper coating can be used to provide the coating for the emulsion layers and other structural layers used in the present invention. Furthermore, it is possible to use simultaneous coating of 2 or more layers with the methods described in U.S. Pat. Nos. 2,761,791 and 2,941,898.

The relative positions of the emulsion layers in the present invention is determined based on the intended use of the photographic material. The sequence, beginning from the support side of blue sensitive emulsion layer, green sensitive emulsion layer, red sensitive emulsion layer or, sequentially from the support side of red sensitive emulsion layer, green sensitive emulsion layer, blue sensitive emulsion layer may be used.

Furthermore, it is possible to provide an ultraviolet absorption layer on the adjacent layer of the support side of the emulsion layer furthest from the support and also, as required, to provide an ultraviolet absorption layer on the layer on the opposite side of the support. In the latter case in particular, it is preferable to provide a protective layer essentially composed only of gelatin on the uppermost layer.

When the present invention is applied to color sensitive prints material, the said sensitive materials undergo color development processing after being exposed through negative sensitive material having a color image formed from coupling products.

Color development processing is carried out using standard color developing methods.

Methods and processing solutions such as those described in, for example Research Disclosure No. 176, pages 28 to 30 (RD-17643) can be applied for the photographic processing of the photosensitive materials of the present invention. If a color image is ultimately to be obtained, the materials may be processed to form a silver image or may be processed to form a direct dye image. A preferred processing temperature is between 18 and 50° C. but temperatures below 18° C. and temperatures in excess of 50° C. may be employed.

There are no particular restrictions on the color photographic processing methods for use in the present invention and various methods may be employed. Representative methods include; the method in which color developing and bleach-fixing pocessing are carried out after exposure followed by water washing and stabilization processing as required; the method in which the color developing, bleaching and fixing processes are carried out separately after exposure followed by water washing and stabilization processing as required; the method in which developing is carried out after exposure with a developing solution containing a black-and-white developing agent and, after uniform exposure, color developing and bleach-fixing are carried out followed by water washing and stabilization processing as required; or the method in which developing is carried out after exposure with a developing solution containing a black-and-white developing agent and a bleach-fix process is further carried out after developing with a color developing solution containing a fogging agent (for example, sodium borohydride) followed by water washing and stabilization processing as required.

The primary aromatic amine color developing agent used for the color developing solution in the present invention encompasses substances used widely in color photographic processes. These developing agents include aminophenol-based and p-phenylenediamine-based derivatives. The preferred examples are p-phenylenediamine derivatives and representative examples are given below, however the invention is not limited to these.

D-1 N,N-diethyl-p-phenylenediamine
D-2 2-amino-5-diethylaminotoluene
D-3 2-amino-5-(N-ethyl-N-laurylamino)toluene
D-4 4-[N-ethyl-N-(β-hydroxyethyl)amino]aniline
D-5 2-methyl-4-[N-ethyl-N-(β-hydroxyethyl-)amino]aniline
D-6 N-ethyl-N-(β-methanesulfonamidoethyl)-3-methyl-4-aminoaniline
D-7 N-(2-amino-5-diethylaminophenylethyl)methanesulfonamide
D-8 N,N-dimethyl-p-phenylenediamine
D-9 4-amino-3-methyl-N-ethyl-N-methoxyethylaniline
D-10 4-amino-3-methyl-N-ethyl-N-β-ethoxyethylaniline
D-11 4-amino-3-methyl-N-ethyl-N-β-butoxyethylaniline Furthermore, these p-phenylenediamine derivatives may be salts such as sulfates, hydrochlorides, sulfites and p-toluenesulfonates. The above compounds are described in U.S. Pat. Nos. 2,193,015, 2,552,241, 2,566,271, 2,592,364, 3,656,950 and 3,698,525. The primary aromatic amine color developing agent is used at a concentration of approximately 0.1 g to approximately 20 g, preferably approximately 0.5 g to approximately 10 g, per mol of developing solution.

It is possible to include substances such as hydroxylamines in the color developing solutions for use in the present invention.

The hydroxylamines can be used in the form of free amines in the color developing solution although it is more common to use them in the form of water-soluble acid salts. Common examples of such salts are sulfates, oxalates, chlorides, phosphates, carbonates, acetates etc. The hydroxylamines may be substituted or unsubstituted and the nitrogen atom of the hydroxylamines may be substituted with an alkyl group.

The amount of hydroxylamine which is added is preferably not more than 10 g and more preferably no more than 5 g per 1 l of color developing solution. If the stability of the color developing solution is to be maintained, less hydroxylamine should be added.

Furthermore, it is preferable to include in the color developing solution sodium sulfite, potassium sulfite, sodium bisulfite, potassium bisulfite, sodium metabisulfite, potassium metabisulfite and other such sulfites and carbonyl sulfite adducts. The added amount of sulfite is preferably not more than 20 g and more preferably not more than 5 g per 1 l of color developing solution and, if the stability of the color developing solution is to be maintained, less sulfite should be added.

Apart from these, the aromatic polyhydroxy compounds disclosed in Japanese Patent Applications (OPI) No. 49,828/77, No. 47,038/81, No. 32,140/81, No. 60,142/84 and in U.S. Pat. No. 3,746,544; the hydroxyacetones disclosed in U.S. Pat. No. 3,615,503 and in British Patent No. 1,306,176; the u-aminocarbonyl compounds disclosed in Japanese Patent Applications (OPI) No. 143,020/77 and No. 89,425/78; the various metals disclosed in Japanese Patent Applications (OPI) NO. 44,148/82 and No. 53,749/82; the various saccharides disclosed in Japanese Patent Application (OPI) No. 102,727/77; the hydroxic acids disclosed in Ibid. 27,638/77; the $\alpha,\alpha'$-dicarbonyl compounds disclosed in Ibid. 160,141/84; the salicylic acids mentioned in Ibid. 180,588/84; the alkanolamines disclosed in Ibid. 3,532/79; the poly(alkyleneimine) compounds disclosed in Ibid. 94,349/81; and the gluconic acid derivatives disclosed in Ibid. 75,647/81 etc. are examples of preservatives which can be used with the present invention. Two or more of these preservatives can be used conjointly as required. The addition of 4,5-dihydroxy-m-benzenedisulfonic acid, poly(ethyleneimine) and triethanolamine etc. is particularly preferred.

The pH of the color developing solution used in the present invention is preferably from 9 to 12 and more preferably from 9 to 11.

It is preferable to use various buffers to maintain the pH of the developing solution. Buffers for this purpose carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valiine salts, proline salts, trishydroxyaminomethane salts, lysine salts etc. In particular, carbonates, phosphates, quaternary borates and hydroxybenzoates have the advantage of excellent solubility and buffering performance in high pH regions of pH 9.0 or above, have no adverse effect (fogging) on the photographic processing performance, and are inexpensive. The use of these buffers is particularly preferred.

Specific examples of these buffers for use in the developing solution of the present invention include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (sodium tetraborate dechaydrate), potassium tetraborate, sodium -o-hydroxybenzoate (sodium salicylate), potassium -o-hydroxybenzoate, sodium -5-sulfo-2-hydroxybenzoate (sodium -5-sulfosalicylate), potassium -5-sulfo-2-hydroxybenzoate (potassium-5-sulfosalicylate) etc. However the buffers are not limited to the above compounds.

The amount of the said buffers added to the color developing solution is preferably not less than 0.1 mol/l and particularly preferred from 0.1 mol/l to 0.4 mol/l.

It is also preferable to use various chelating agents in the color developing solution such as calcium or magnesium antiprecipitation agents in order to improve the stability of the color developing solution.

Organic acid compounds are preferred for use as chelating agents which include the aminopolycarbonates described in Japanese Patent Documents No. 030,496/73 and No. 30,232/69, the organic phosphonates disclosed in Japanese Patent Application (OPI) No. 97,347/81, Japanese Patent Publication No. 39,359/81 and West German Patent No. 2,227,639, the phosphonocarbonates disclosed in Japanese Patent Applications (OPI) No. 102,726/77, No. 42,730/78, No. 121,127/79, No. 126,241/80 and No. 65,956/80 etc. as well as the compounds disclosed in Japanese Patent Applications (OPI) No. 195,845/83, No. 203,440/83 and Japanese Patent Document No. 40,900/78 etc. Specific examples are listed below but the present invention is not limited to these.

Nitrilotriacetic acid
Diethyleneaminopenta-acetic acid
Ethylenediaminetetra-acetic acid
Triethylenetetraminehexa-acetic acid
N,N,N-Trimethylenephosphonic acid
Ethylenediamine-N,N,N',N'-tetramethylenephosphonic acid
1,3-Diamino-2-propanol-tetra-acetic acid
Trancyclohexanediaminetetra-acetic acid
Nitrilotripropinoic acid
1,2-Diaminopropanetetra-acetic acid
Hydroxyethyliminodiacetic acid
Glycoletherdiaminetetra-acetic acid
Hydroxyethylenediaminetriacetic acid
Ethylenediamineorthohydroxyphenylacetic acid
2-Phosphonobutane-1,2,4-tricarboxylic acid
1-Hydroxyethane-1,1-diphosphonic acid
N,N'-bis(2-Hydroxybenzyl)ethylenediamine-N,N'-diacetic acid Two or more types of these chelating agents may be used conjointly as required. The amount of these chelating agents which is added should be enough to sequester the metal ions in the color developing solution which is, for example, about 0.1 g to 10 g per liter.

Development accelerators can be added to the color developing solution as required.

Aside from benzyl alcohol, it is possible to add, as required, the thioether-based compounds disclosed in Japanese Patent Documents No. 16,088/62, No. 5,987/62, No. 7,826/63, 12,380/69, No. 9,019/70 and U.S. Pat. No. 3,813,247 etc., the p-phenylenediamine-based compounds disclosed in Japanese Patent Applications (OPI) No. 49,829/77 and No. 15,554/75; the quaternary ammonium salts disclosed in Japanese Patent Application (OPI) No. 137,726/75, Japanese Patent Document No. 30,074/69, Japanese Patent Applications (OPI) No. 156,826/81 and No. 43,429/77 etc.; the p-aminophenols disclosed in U.S. Pat. Nos. 2,610,122 and 4,119,462; the amine-based compounds disclosed in U.S. Pat. Nos. 2,494,903, 3,128,182, 4,230,796, 3,252,919, Japanese Patent Document No. 11,431/66, U.S. Pat. Nos. 2,482,546, 2,596,926 and 3,582,346 etc.; the polyalkylene oxides disclosed in Japanese Patent Documents No. 16,088/62, No. 25,201/67, U.S. Pat. No. 3,128,183, Japanese Patent Documents No. 11,431/66, No. 23,883/67 and U.S. Pat. No. 3,532,501 etc. and also 1-phenyl-3-pyrazolidones, hydrazines, mesoionic-type compounds, thione-type compounds, imidazoles etc. as development accelerators. In particular, thioether-based compounds and 1-phenyl-3pyrazolidones are preferred.

Antifoggants can be added to the color developing solution of the present invention as required. Alkali metal halides such as potassium bromide, sodium bromide, and potassium iodide and organic antifoggants can be used as antifoggants. Such organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole and hydroxyazaindolidene; mercapto-substituted heterocyclic compounds such as 1-phenyl-5-mercaptotetrazole, 2-mercaptobenzimidazole and 2mercaptobenzothiazole; adenine; and mercapto-substituted aromatic compounds such as thiosalicylic acid. These antifoggants may be accumulated in the color developing solution by elution from the silver halide color photographic material during processing. Lower accumulated amounts of these antifoggants are preferred from the point of view of reducing the discharge volume.

Brightening agents are preferably included in the color developing solutions of the present invention. 4,4'-diamino-2,2'-disulfostilbene-based compounds are preferred as brightening agents. The added amount is from 0 to 5 g/l and preferably from 0.1 g to 2 g/l.

Furthermore, various surfactants such as alkylphosphonic acid, arylphosphonic acid, aliphatic carboxylic acid and aromatic carboxylic acid may be added as required.

The processing temperature of the color developing solution in this invention is preferably from 30° to 50° C. and more preferably from 33° to 42° C. The replenishment amount is 30 to 1,500 cc, preferably 30 to 600 cc and more preferably 30 to 300 cc per $m^2$ of photosensitive material. Lower replenishment amounts are preferred from the point of view of reducing the amount discharge.

Ferric ion complexes may be used in the bleaching solution or bleach-fixing solution of the present invention. Complexes of ferric ions with chelating agents such as aminopolycarboxylic acid, aminopolyphosphonic acid or salts thereof are preferred ferric ion complexes. The salts of aminopolycarboxylic acid or aminopolyphosphonic acid with alkali metals, ammonium or water-soluble amines are preferred as aminopolycarboxylic acid salts or aminopolyphosphonic acid salts. The alkali metals include sodium, potassium and lithium, and the water-soluble amines include alkylamines such as methylamine, diethylamine, triethylamine and butylamine, alicyclic amines such as cyclohexylamine, aryl amines such as aniline and m-toluidine and heterocyclic amines such as pyridine, morpholine and piperidine.

Typical non-limiting examples of chelating agents for these aminopolycarboxylic acids and aminopolyphosphonic acids or salts thereof etc. include;

Ethylenediaminetetra-acetic acid
Ethylenediaminetetra-acetic acid disodium salt
Ethylenediaminetetra-acetic acid diammonium salt
Ethylenediaminetetra-acetic acid tetra(trimethylammonium) salt
Ethylenediaminetetra-acetic acid tetrapotassium salt
Ethylenediaminetetra-acetic acid tetrasodium salt
Ethylenediaminetetra-acetic acid trisodium salt
Diethylenetriaminepenta-acetic acid
Diethylenetriaminepenta-acetic acid pentasodium salt
Ethylenediamine-N-(α-oxyethyl)-N,N',N'-triacetic acid
Ethylenediamine-N-(α-oxyethyl)-N,N',N'-triacetic acid trisodium salt
Ethylenediamine-N-(α-oxyethyl)-N,N',N'-triacetic acid triammonium salt
Propylenediaminetetra-acetic acid
Propylenediaminetetra-acetic acid disodium salt
Nitrilotriacetic acid
Nitrilotriacetic acid trisodium salt
Cyclohexanediaminetetra-acetic acid
Cyclohexanediaminetetra-acetic acid disodium salt
Iminodiacetic acid
Dihydroxyethylglycine
Ethyletherdiaminetetra-acetic acid
Glycoletherdiaminetetra-acetic acid
Ethylenediaminetetrapropionic acid
Phenylenediaminetetra-acetic acid
1,3-Diaminopropanol-N,N,N',N'-tetramethylenephosphonic acid
Ethylenediamine-N,N,N'N'-tetramethylenephosphonic acid
1,3-Propylenediamine-N,N,N',N'tetramethylenephosphonic acid The ferric ion complexes may be used in the form of complexes and ferric ion complexes may be formed in solution using ferric salts, for example, ferric sulphate, ferric chloride, ferric nitrate, iron(III) ammoniumsulphate, ferric phosphate etc. with chelating agents such as aminopolycarboxylic acid, aminopolyphosphonic acid, phosphonocarboxylic acid etc. When used in the form of complexes, one type of complex may be used or two or more types of complexes may be used. Additionally, when forming complexes in solution using ferric salts and chelating agents, one type or two or more types of ferric salts may be used. In addition to this, one type, or two or more types, of chelating agents may be used. Moreover, the chelating agent may be used in excess of the amount for forming the ferric ion complexes. Of the iron complexes, the iron aminopolycarboxylic acid complex is preferred, the amount added being from 0.01 to 1.0 mol/l and preferably from 0.05 to 0.50 mol/l.

It is also possible to use a bleach accelerator in the bleaching solution or the bleach-fixing solution as required. Specific examples of useful bleach accelerators include compounds having a mercapto group or disulfide group disclosed in U.S. Pat. No. 3,893,858, West German Patents No. 1,290,812 and No. 2,059,988, Japanese Patent Applications (OPI) No. 32,736/78, No. 57,831/78, No. 37,418/78, No. 65,732/78, No. 72,623/78, No. 95,630/78, No. 95,631/78, No. 104,232/78, No. 124,424/78, No. 141,623/78 and No. 28,426/78, Research Disclosure No. 17129 (July 1978) etc.; the thiazolidine derivatives disclosed in Japanese Patent Application (OPI) No. 140,129/75; the thiourea derivatives disclosed in Japanese Patent Document No. 8,506/70, Japanese Patent Applications (OPI) No. 20,832/77 and No. 32,735/78, U.S. Pat. No. 3,706,561; the iodine compounds disclosed in West German Patent No. 1,127,715, Japanese Patent Application (OPI) No. 16,235/83; the polyethylene oxides disclosed in West German Patents No. 966,410 and No. 2,748,430; the polyamine compounds disclose in Japanese Patent Document No. 8,836/70; as well as the compounds disclosed in Japanese Patent Applications (OPI) No. 42,434/74, No. 59,644/74, No. 94,927/78, No. 35,727/79, No. 26,506/80 and No. 163,940/83 and idodine and bromine ions etc. Of these, compounds having a mercapto group or disulfide group are preferred in that they have a large accelerating effect. The compounds disclosed in U.S. Pat. No. 3,893,858, West German Patent No. 1,290,812 and Japanese Patent Application (OPI) No. 95,630/78 are particularly preferred.

In the bleaching solution or bleach-fixing solution of the present invention preferably includes bromine compounds (for example, potassium bromide, sodium bromide, ammonium bromide) or chlorine compounds (for example, potassium chloride, sodium chloride, ammonium chloride) or iodine compounds (for example, ammonium iodide) which serve as rehalogenating agents. It is possible to add, as required, one or more anti-corrosion agents such as quanidine, ammonium nitrate and the inorganic acids, organic acids, and alkali metal and ammonium salts thereof, and those which have a pH buffering action such as boric acid, sodium tetraborate decahydrate, sodium metaborate, acetic acid, sodium acetate, sodium carbonate, potassium carbonate, phosphorus acid, phosphoric acid, potassium phosphate, citric acid, sodium citrate and tartaric acid.

The fixing agents used in the bleach-fixing solutions or fixing solutions of the present invention include sodium thiosulfate, ammonium thiosulfate and other such thiosulfate salts; sodium thiocyanate, ammonium thiocyanate and other such thiocyanate salts; and ethylenebisthioglycolic acid, 3,6-dithia-1,8-octanediol and other such thioether compounds and thioureas and like water-soluble silver halide solvent. Furthermore, it is possible to use one type of fixing agent or to mix two or more types. Furthermore, it is possible to use special bleach-fixing solutions composed of a combination of fixing agents and large quantities of halide compounds such as potassium iodide as disclosed in Japanese Patent Application (OPI) No. 155,354/80. In this invention, the use of thiosulfate salts and, in particular, ammonium thiosulfate salts is preferred.

The amount of fixing agent for 1 l is preferably within the range of from 0.3 to 2 mol and more preferably from 0.5 to 1.0 mol.

The pH range of the bleach-fixing solution or fixing solution of the present invention is preferably from 3 to 10, and from 4 to 9 is particularly preferred. When the pH is relatively low, the desilvering properties of the solution and the leucoization of the cyan dye during processing are accelerated. Conversely, when the pH is relatively high, the desilvering is slow and staining readily occurs.

In order to adjust the pH, it is possible to add, as required, hydrochloric acid, sulfuric acid, nitric acid, acetic acid (glacial acetic acid), bicarbonates, ammonia, potassium hydroxide, sodium hydroxide, sodium carbonate or potassium carbonate etc.

Apart from these, it is also possible to include various brightening agents and antifoaming agents or surfactants and organic solvents such as polyvinylpyrrolidone or methanol, etc. in the bleach-fixing solution.

The bleach-fixing solutions and fixing solutions of the present invention include sulfite ion releasing compounds such as sulfite salts (for example, sodium sulfite, potassium sulfite, ammonium sulfite etc.), bisulfite salts (for example, ammonium bisulfite, sodium bisulfite, potassium bisulfite etc.), metabisulfite salts (for example, potasium metabisulfite, sodium metabisulfite, ammonium metabisulfite etc.), as preserving agents. These compounds are preferably included at concentrations of approximately 0.02 to 0.50 mol/l and more preferably at 0.04 to 0.40 mol/l with respect to sulfite ion.

It is common to add sulfite salts as preserving agents although, apart from these, ascorbic acid and carbonyl bisulfite adducts or carbonyl compounds etc. may be added.

Furthermore, buffers, brightening agents, chelating agents, sterilizing agents etc. can be added as required.

The water-washing process of the present invention is described as follows: With the present invention, it is possible to use simple processing methods such as those in which only a so-called "stabilization process" is carried out instead of the usual "water-washing process" without providing an essentially water-washing operation. In this invention, "water-washing process" is thus used in a broad sense as above.

The amount of washing water for use in the present invention varies according to the number of baths in the multistage counter-flow wash and the amount of carry-over of prebath constituents by the photosensitive material. However, the concentration of prebath constituents having a bleach-fixing capacity in the final water-wash bath in this invention is preferably no more than $5\times10^{-2}$ ml/ml and more preferably no more than $2\times10^{-2}$ ml/ml. For example, in the case of 3-tank counter-flow washing, the use of no less than about 1,000 cc per 1 $m^2$ of photo-sensitive material is preferred. Furthermore, in the case of water-saving processes, the use of no less than 1,000 cc per 1 $m^2$ of photo-sensitive material is preferred.

The washing temperature is from 15° C. to 45° C., and preferably from 20° C. to 40° C.

Various compounds may be added in the water-wash processing operation in order to prevent sedimentation and to stabilize the wash water. For example, inorganic phosphoric acid, aminopolycarboxylic acid, organic phosphonic acid and other such chelating agents, disinfectants and sterilizing agents which prevent the occurrence of various bacterias, algi and fungi, and, for example, the compounds disclosed in "J. Antibact. Antifung. Agents) Vol. 11, No. 5, p. 207 to 223 (1983) and the compounds disclosed in "The Chemistry of Bacterial and Fungal Prevention" by Dr. Horiguchi, metal salts typified by magnesium salts and aluminum salts, alkali metal and ammonium salts, or surfactants for preventing dry loading and unevenness etc. can be added as required. Alternatively, the compounds disclosed in "Photographic Science and Engineering" by West, Vol. 6, p. 344 to 359, 1965 etc. may also be added.

Furthermore, the use of washing water having reduced amounts of potassium, magnesium etc. as disclosed in Japanese Patent Application (OPI) No. 131,632/86 is particularly preferred for use in the present invention.

Moreover, the present invention is particularly effective in case where chelating agents and disinfectants and sterilizing agents are added to the washing water and wherein the amount of washing water is greatly reduced by means of a multi-stage counter-flow washing with 2 or more tanks. The present invention is also particularly effective when a multi-stage counter-flow stabilization processing operation as described in Japanese Patent Application (OPI) No.8,543/82 is used in place of the washing operation. In such processes, the bleach-fixing constituents in the final bath should not be more than $5\times10^{-2}$ ml/ml and preferably not more than $1\times10^{31\ 2}$ ml/ml by weight.

Various compounds are added to this stabilization bath to stabilize the image. Typical examples include, for example, various buffers (for example, the combined use of borate salts, methaborate salts, sodium tetraborate decahydrate, phosphate salts, carbonate salts, potassium hydroxide, sodium hydroxide, ammonia water, monocarboxylic acid, dicarboxylic acid, polycarboxylic acid etc.) and formalin and other such aldehydes for adjusting the film pH (to pH 3 to 8 for example). Apart from these, chelating agents (inorganic phosphoric acid, aminopolycarboxylic acid, organic phosphonic acid, aminopolyphosphonic acid, phosphonocarboxylic acid etc.), disinfectants (thiazole-based, isothiazole-based, phenol halides, sulfanilamides, benzotriazole etc.), surfactants, brightening agents, film hardening agents and various other such additives can be used and two ro more compounds can be used conjointly for the same or different purposes.

Furthermore, in order to improve the image storage properties, the addition of various ammonium salts such as ammonium chloride, ammonium nitrate, ammonium sulfate, ammonium phosphate, ammonium sulfite and ammonium thiosulfate as film pH adjusting agents after processing is preferred.

In processes as above, the amount of waste solution may be reduced by directing the wash water overflow into the bleach-fixing bath or the fixing bath.

When carrying out continuous processing, a repeatable finish is obtained by preventing the transfer of solution constituents through the use of a replenishment solution for each processing solution. In order to reduce costs, etc. while maintaining good photographic properties the replenished amounts are preferably kept low by the adjusting processing conditions such as composition of the processing solution, the temperature, processing time and agitation.

As required, it is preferable to equip the various processing baths with heaters, thermosensors, solution level sensors, recycling pumps, filters, various float lids, various squeegees, nitrogen agitation, air agitation and similar equipment.

The color photographic processing described herein is applicable to any processing operation using color developing solutions. For example, it is applicable to the processing of color paper, color reversal paper, color positive film, color negative film and color reversal film, etc.

EXAMPLE 1

30 g of lime treated gelatin was added to 1,000 cc of distilled water and dissolved at 40° C. The pH was then adjusted to 3.8 with sulfuric acid. 6.5 g of sodium chloride and 0.02 g of N,N'-dimethylethylenethiourea were added and the temperature raised to 70° C. A solution in which 62.5 g of silver nitrate had been dissolved in 750 cc of distilled water and a solution in which 30.6 g of potassium bromide and 6.5 g of sodium chloride had been dissolved in 500 cc of distilled water were added and mixed with the above solution for at least 40 minutes while maintaining at temperature of 70° C. Furthermore, a solution in which 62.5 g of silver nitrate had been dissolved in 500 cc of distilled water and a solution in which 30.6 g of potassium bromide and 6.5 g of sodium chloride had been dissolved in 300 cc of distilled water were added and mixed with this emulsion for at least 20 minutes at a temperature of 70° C. The emulsion thus obtained was examined under an electron microscope and was found to comprise cubic grains having an average edge length of about 0.47μ. The grain size distribution of the emulsion thus obtained was measured and was found to be a monodisperse emulsion with a variation coefficient of 0.13. After this emulsion had been washed and desalted, it was optimally chemically sensitized using triethylthiourea in the presence of nucleic acid decomposition products and illustrative compound (III-1). This was designated emulsion A1.

Emulsions in which the pH during grain formation was adjusted from 3.8 to 5.8, 7.4, 7.8, 9.0, 10.4 and 11.2 with either sulfuric acid or sodium hydroxide were prepared and optimal sulfur sensitization was performed in the same way as for emulsion A1. These were designated emulsions A2 to A7. The average grain sizes of emulsions A2 to A7 were 0.47μ for A2 to A3, and 0.48μ for A4 to A7. Furthermore, A2–A7 were all monodisperse emulsions with a grain size distribution variation coefficient of 0.10 to 0.14.

Emulsions A1 to A7 were used with the addition of illustrative compounds (III-1), (V-4) , (F-7) and (II-1).

30 g of lime treated gelatin were added to 1,000 cc of distilled water and dissolved at 40° C. and then the pH was adjusted to 3.8 with sulfuric acid. 6.5 g of sodium chloride and 0.02 g of N,N'-dimethylethylenethiourea were added thereto and the temperature raised to 71° C. A solution in which 62.5 g of silver nitrate had been dissolved in 750 cc of distilled water and a solution in which 32.8 g of potassium bromide and 5.4 g of sodium chloride had been dissolved in 500 cc of distilled water was added and mixed with the above solution for at least 40 minutes while maintaining a temperature of 71° C. Furthermore, a solution in which 62.5 g of silver nitrate had been dissolved in 500 cc of distilled water and a solution in which 28.5 g of potassium bromide and 7.5 g of sodium chloride had been dissolved in 300 cc of distilled water were added and mixed with this emulsion for at least 20 minutes at a temperature of 69° C. The emulsion thus obtained was examined under an electron microscope and was found to comprise cubic grains -having an average side length of about 0.47μ. The grain size distribution of the emulsion thus obtained was measured and was found to be a monodisperse emulsion with a variation coefficient of 0.13. After this emulsion was washed and desalted, it was optimally chemically sensitized by triethylthiourea in the presence of nucleic acid decomposition products and illustrative compound (III-1). This was designated emulsion B1.

Furthermore, emulsions in which the pH during grain formation was adjusted from 3.8 to 5.8, 7.4 7.8, 9.0, 10.4 and 11.2 with either sulfuric acid or sodium hydroxide were prepared and optimum sulfur sensitization performed in the same way as for emulsion B1. These were designated emulsions B2 to B7. The average grain sizes of emulsions B2 to B7 were 0.47μ for B2 to B4 and 0.48μ for B5 to B7. Furthermore, B2–B7 were all monodisperse emulsions with a grain size distribution variation coefficient of 0.10 to 0.15.

Emulsions B1 to B7 were used with the addition of illustrative compounds (III-1), (V-4), (F-7) and (II-1).

30 g of lime treated gelatin were added to 1,000 cc of distilled water and dissolved at 40° C., and the pH was then adjusted to 3.8 with sulfuric acid. 6.5 g of sodium chloride and 0.02 g of N,N'-dimethylethylenethiourea were added and the temperature was raised to 72.5° C. A solution in which 62.5 g of silver nitrate had been dissolved in 750 cc of distilled water and a solution in which 35.0 g of potassium bromide and 4.3 g of sodium chloride had been dissolved in 500 cc of distilled water were added and mixed with the above solution for at least 40 minutes while maintaining a temperature of 72.5° C. Furthermore, a solution in which 62.5 g of silver nitrate had been dissolved in 500 cc of distilled water and a solution in which 26.3 g of potassium bromide and 8.6 g of sodium chloride had been dissolved in 300 cc of distilled water were added and mixed with this emulsion for at least 20 minutes at a temperature of 67.5° C. The emulsion thus obtained was examined under an electron microscope and was found to comprise cubic grains having an average side length of about 0.47μ. The grain size distribution of this emulsion was measured and was found to be a monodisperse emulsion with a variation coefficient of 0.12. After this emulsion was washed and desilvered, it was optimally chemically sensitized by triethylthiourea in the presence of nucleic acid decomposition products and illustrative compound (III-1). This was designated emulsion C1.

Furthermore, emulsions in which the pH during grain formation was adjusted from 3.8 to 5.8, 7.4, 7.8, 9.0, 10.4 and 11.2 with either sulfuric acid or sodium hydroxide were prepared and optimum sulfur sensitization carried out in the same way as for emulsion C1. These were designated emulsions C2 to C7. The average grain sizes for emulsions C2 to C7 were 0.47μ for C2 and C4 and 0.48μ for C3, C4, C5, C6 and C7. Furthermore, C2-C7 were all monodisperse emulsions with a grain size distribution variation coefficient of 0.12 to 0.15.

Emulsions C1 to C7 were used with the addition of illustrative compounds (III-1), (V-4), (F-7) and (II-1).

30 g of lime treated gelatin were added to 1,000 cc of distilled water and dissolved at 40° C., and the pH was then adjusted to 3.8 with sulfuric acid. 6.5 g of sodium chloride and 0.02 g of N,N'-dimethylethylenethiourea were added and the temperature was raised to 75° C. A solution in which 62.5 g of silver nitrate had been dissolved in 750 cc of distilled water and a solution in which 39.4 g of potassium bromide and 2.2 g of sodium chloride had been dissolved in 500 cc of distilled water were added and mixed with the above solution for at least 40 minutes while maintaining a temperature of 75° C. Furthermore, a solution in which 62.5 g of silver nitrate had been dissolved in 500 cc of distilled water and a solution in which 21.9 g of potassium bromide and 10.8 g of sodium chloride had been dissolved in 300 cc of distilled water were added and mixed with this emulsion for at least 20 minutes at a temperature of 65° C. The emulsion thus obtained was examined under an electron microscope and was found to comprise cubic grains having an average side length of about 0.47μ. The grain size distribution of this emulsion was measured and was found to be a monodisperse emulsion with a variation coefficient of 0.15. After washing and desalting, the emulsion was optimally chemically sensitized by triethylthiourea in the presence of nucleic acid decomposition products and illustrative compound (III-1). This was designated emulsion D1.

Furthermore, emulsions in which the pH during grain formation was adjusted from 3.8 to 5.8, 7.4, 7.8, 9.0, 10.4 and 11.2 with either sulfuric acid or sodium hydroxide were prepared and optimum sulfur sensitization carried out in the same way as for emulsion D1. These were designated emulsions D2 to D7. The average grain sizes for emulsions D2 to D7 were 0.47μ for D2 and D4 and 0.48μ for D5 and D7. Furthermore, D2-D7 were all monodisperse emulsions with a grain size distribution variation coefficient of 0.12 to 0.16.

Emulsions D1 to D7 were used with the addition of illustrative compounds (III-1), (V-4), (F-7) and (II-1).

30 g of lime treated gelatin were added to 1,000 cc of distilled water and dissolved at 40° C. and the pH was then adjusted to 3.8 with sulfuric acid. 6.5 g of sodium chloride and 0.02 g of N,N'-dimethylethylenethiourea were added and the temperature was raised to 65° C. A solution in which 62.5 g of sodium nitrate had been dissolved in 750 cc of distilled water and a solution in which 21.9 g of potassium bromide and 10.8 g of sodium chloride had been dissolved in 500 cc of distilled water were added and mixed with above solution for at least 40 minutes while maintaining a temperature of 65° C. Furthermore, a solution in which 62.5 g of silver nitrate had been dissolved in 500 cc of distilled water and a solution in which 39.4 g of potassium bromide and 2.2 g of sodium chloride had been dissolved in 300 cc of distilled water were added and mixed with this emulsion for 20 minutes at a temperature of 75° C. The emulsion thus obtained was examined under an electron microscope and was found to comprise cubic grains slightly lacking in the corners having an average side length of about 0.47 p. The grain size distribution of this emulsion was measured and was found to be a monodisperse emulsion with a variation coefficient of 0.14. After washing and desalting, the emulsion was optimally chemically sensitized with triethylthiourea in the presence of nucleic acid decomposition products and illustrative compound (III-1). This was designated emulsion E1.

Furthermore, emulsions in which the pH during grain formation had been adjusted from 3.8 to 5.8, 7.4, 7.8, 9.0, 10.4 and 11.2 with either sulfuric acid or sodium hydroxide were prepared and optimum sulfur sensitization carried out in the same way as for emulsion E1. These were designated emulsions E2 to E7. The average grain sizes for emulsions E2 to E7 were 0.47μ for E2, E3 and E5 and 0.48μ for E1, E4, E6 and E7. Furthermore, they were all monodisperse emulsions with a grain size distribution variation coefficient of 0.11 to 0.16.

Emulsions E1 to E7 were used with the addition of illustrative compounds (III-1) , (V-4), (F-7) and (II-1).

Using the above emulsions A1 to A7, B1 to B7, C1 to C7, D1 to D7 and E1 to E7, test materials with the respective coated amounts of various composition as shown below were prepared by coating onto designated supports.

The multipart compositional structure is obtainable by calculation based on a ratio of potassium bromide to silver nitrate and an amount of sodium chloride. Silver bromide content ratio of core to shell (the balance being an amount of silver chloride) and a ratio of core to shell in each emulsion prepared in Example 1 are as follows.

| Emulsion | Silver Bromide content of core/shell | core/shell |
|---|---|---|
| $A_1$ to $A_7$ | 70 mol % | — |
| $B_1$ to $B_7$ | 75/65 (mol %/mol %) | 1/1 |
| $C_1$ to $C_7$ | 80/60 (mol %/mol %) | 1/1 |
| $D_1$ to $D_7$ | 90/50 (mol %/mol %) | 1/1 |
| $E_1$ to $E_7$ | 50/90 (mol %/mol %) | 1/1 |

Support

Paper laminated on both surfaces with polyethylene (containing 3.0 g/m$^2$ of titanium dioxide in the polyethylene film)

| Emulsion Layer | |
|---|---|
| Silver halide emulsion layer (as silver) | 0.25 g/m$^2$ |
| Gelatin | 1.45 g/m$^2$ |
| Coupler (a) | 0.33 g/m$^2$ |
| Color image stabilizer (b) | 0.15 g/m$^2$ |
| Color image stabilizer (c) | 0.20 g/m$^2$ |
| Color image stabilizer (d) | 0.04 g/m$^2$ |

Protective layer

Gelatin 1.30 g/m$^2$ 1,2-Bisvinylsulfonylethane was used as the gelatin hardening agent.

These materials were exposed to a white light for 0.1 seconds using an optical wedge and a red filter at a room temperature of about 25° C. The following color development processing was then carried out at times of from 30 seconds to 1 minute.

The results obtained are shown in Table 1. The heading "Speed" of Table 1 shows the difference in speed compared to test material A1, as the logarithm of the reciprocal of the exposure giving a red density fogging of +1.0. Furthermore, the latent image stability shows the difference in sensitivity for various materials in which the above exposure is made and which was then stored for 20 minutes at a temperature of 30° C. and 40% RH before undergoing the same color development processing.

It will be seen that the materials using the emulsions B4 to B6, C4 to C6, D4 to D6 and E4 to E6 of this invention are of high speed and have a good latent image stability. Also, little pressure fogging occurs with the emulsion of this invention.

(a)

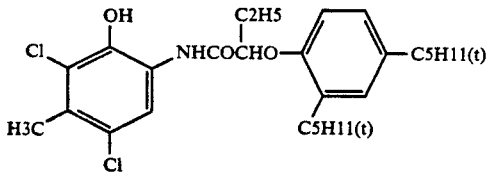

and

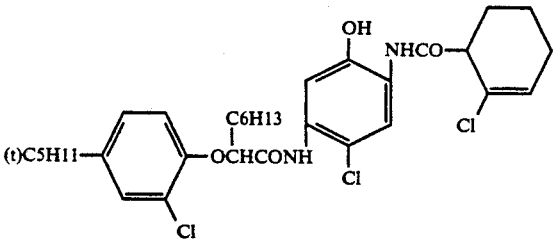

a 1:1 mixture (mole ratio)

(b)

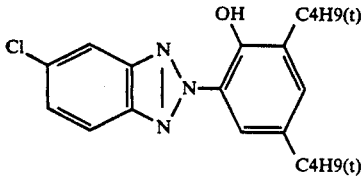

-continued and

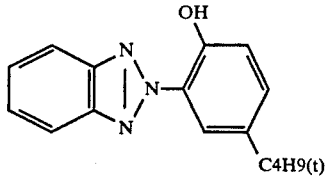

and

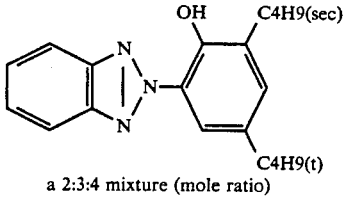

a 2:3:4 mixture (mole ratio)

(c)

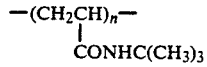

average molecular weight approximately 70,000

(d)

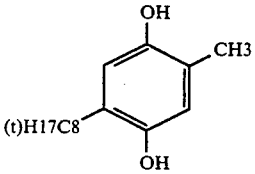

| Processing | Temperature | Time |
|---|---|---|
| Color development | 37° C. | 3 min. 30 sec. |
| Bleach-fixing | 33° C. | 1 min. 30 sec. |
| Washing | 24–34° C. | 3 min. |
| Drying | 70–80° C. | 1 min. |

The composition of each processing solution was as follows.

| Color developing solution | |
|---|---|
| Water | 800 cc |
| Diethylenetriaminepenta-acetic acid | 1.0 g |
| Nitrilotriacetic acid | 2.0 g |
| Benzyl alcohol | 15.0 cc |
| Diethylene glycol | 10.0 cc |
| Sodium sulfite | 2.0 g |
| Potassium bromide | 1.0 g |
| Potassium carbonate | 30.0 g |
| N-Ethyl-N-(β-methanesulfonamidoethyl)-3-methyl-4-aminoanilinesulfuric acid salt | 4.5 g |
| Hydroxylamine sulfuric acid salt | 3.0 g |
| Brightening agent (Whitex 4B, produced by Sumitomo Kagaku Co.) | 1.0 g |
| Water | to make 1,000 cc |
| pH (25° C.) | 10.25 |
| **Bleach-fixing solution** | |
| Water | 400 cc |
| Ammonium thiosulfate (70%) | 150 cc |
| Iron (III) ammonium ethylene-diaminetetra-acetate | 55.0 g |
| Disodium ethylenediaminetetra-acetate | 5.0 g |
| Water | to make 1,000 cc |
| pH (25° C.) | 6.70 |

Washing

Ion exchange water (calcium ion, magnesium ion concentration about 0.5 ppm each).

TABLE 1

| Test material | Speed | Fogging | Latent image stability | Type |
|---|---|---|---|---|
| A1 | 0.00 | 0.09 | −0.05 | Comp. ex. |
| A2 | 0.01 | 0.09 | −0.05 | Comp. ex. |
| A3 | 0.08 | 0.09 | −0.05 | Comp. ex. |
| A4 | 0.18 | 0.09 | −0.04 | Comp. ex. |
| A5 | 0.23 | 0.09 | −0.04 | Comp. ex. |
| A6 | 0.23 | 0.10 | −0.04 | Comp. ex. |
| A7 | 0.19 | 0.19 | −0.04 | Comp. ex. |
| B1 | 0.06 | 0.09 | −0.04 | Comp. ex. |
| B2 | 0.07 | 0.09 | −0.04 | Comp. ex. |
| B3 | 0.14 | 0.09 | −0.04 | Comp. ex. |
| B4 | 0.22 | 0.09 | −0.03 | This invention |
| B5 | 0.26 | 0.09 | −0.02 | This invention |
| B6 | 0.27 | 0.10 | −0.02 | This invention |
| B7 | 0.19 | 0.25 | −0.02 | Comp. ex. |
| C1 | 0.10 | 0.09 | −0.04 | Comp. ex. |
| C2 | 0.12 | 0.09 | −0.04 | Comp. ex. |
| C3 | 0.19 | 0.09 | −0.04 | Comp. ex. |
| C4 | 0.29 | 0.09 | −0.02 | This invention |
| C5 | 0.32 | 0.09 | −0.01 | This invention |
| C6 | 0.33 | 0.11 | −0.01 | This invention |
| C7 | 0.22 | 0.35 | −0.01 | Comp. ex. |
| D1 | 0.40 | 0.09 | −0.03 | Comp. ex. |
| D2 | 0.42 | 0.09 | −0.03 | Comp. ex. |
| D3 | 0.47 | 0.09 | −0.03 | Comp. ex. |
| D4 | 0.56 | 0.09 | −0.01 | This invention |
| D5 | 0.58 | 0.09 | 0.00 | This invention |
| D6 | 0.58 | 0.11 | 0.00 | This invention |
| D7 | 0.43 | 0.42 | −0.01 | Comp. ex. |
| E1 | 0.42 | 0.09 | −0.03 | Comp. ex. |
| E2 | 0.44 | 0.09 | −0.03 | Comp. ex. |
| E3 | 0.47 | 0.09 | −0.03 | Comp. ex. |
| E4 | 0.58 | 0.09 | −0.01 | This invention |
| E5 | 0.59 | 0.09 | −0.01 | This invention |
| E6 | 0.58 | 0.12 | −0.01 | This invention |
| E7 | 0.43 | 0.45 | −0.01 | Comp. ex. |

Comp. ex. = Comparative example

EXAMPLE 2

Emulsions A1 to A7, B1 to B7, C1 to C7, D1 to D7 and E1 to E7 were prepared as in Example 1 with the addition of $8\times10^{-7}$ mol or iridium dipotassium hexachloride per mol of silver and the change of the added illustrative compounds (V-4), (F-7) and (II-1) to illustrative compounds (V-29), (V-45) and (I-2). These were designated emulsions F1 to F7, G1 to G7, H1 to H7, I1 to I7 and J1 to J7 respectively.

The coated test materials with the structures shown in Table II were prepared using the above emulsions as the green sensitive layer.

An emulsion Z1 composed of cubic grains with a silver bromide content of 80 mol. %, an average grain size of 0.87μ and a grain size distribution variation coefficient of 0.11 together with a cubic emulsion Z2 with the same halogen composition, an average grain size of 0.62μ and a variation coefficient of 0.09 were mixed for use in the blue sensitive layer.

Furthermore, emulsions B5 and D5 of Example 1 were mixed and used in the red sensitive layer.

These test materials were exposed through an optical wedge and a green filter for 0.1 seconds and the color development processing shown below was carried out.

| Processing | Temperature | Time |
|---|---|---|
| Color development | 38° C. | 1 min. 40 sec. |
| Bleach-fixing | 30–34° C. | 1 min. 00 sec. |
| Rinse 1 | 30–34° C. | 20 sec. |
| Rinse 2 | 30–34° C. | 20 sec. |
| Rinse 3 | 30–34° C. | 20 sec. |
| Drying | 70–90° C. | 50 sec. |

(A three tank counter-flow system from rinse 3-1 was employed).

The composition of each processing solution is as shown below.

| | |
|---|---|
| Color developing solution | |
| Water | 800 cc |
| Diethylenetriamine penta-acetic acid | 1.0 g |
| 1-Hydroxyethylidene-1,1-diphosphonic acid (60%) | 2.0 g |
| Nitrilotriacetic acid | 2.0 g |
| Benzyl alcohol | 16.0 cc |
| Diethylene glycol | 10.0 cc |
| Sodium sulfite | 2.0 g |
| Potassium bromide | 0.5 g |
| Potassium carbonate | 30.0 g |
| N-Ethyl-N-(β-methanesulfonamidoethyl)-3-methyl-4-aminoaniline sulfuric acid salt | 5.5 g |
| Hydroxylamine sulfuric acid salt | 3.0 g |
| Brightening agent (Whitex 4B, Sumitomo Kagakusei) | 1.5 g |
| Water | to make 1,000 cc |
| pH (25° C.) | 10.25 |
| Bleach-fixing solution | |
| Water | 400 cc |
| Ammonium thiosulfate (70%) | 200 cc |
| Sodium sulfite | 20.0 g |
| Iron (III) ammonium ethylenediaminetetra-acetate | 60.0 g |
| Disodium ethylenediaminetetra-acetate | 10.0 g |
| Water | to make 1,000 cc |
| pH (25° C.) | 6.70 |

Rinse solution

Ion exchange water (Ca ion, Mg ion concentrations 1.5 ppm respectively).

The test materials thus prepared were stored at 27° C. The time prior to start of developing was in two divisions of about 1 minute and about 30 minutes following exposure. The difference in speed thus measured was used to evaluate the latent image storage properties.

The "Speed" is given in Table 3 as the numerical value of the divergence from the speed of test material F1 as the logarithm of the reciprocal of the exposure giving a green filter density of fogging +1.0. Furthermore, pressure fogging is shown as the value of the fogging when the coated test material is bent at 60° C.

The results obtained are given in Table 3. The designation of the test material is represented by the designation of the emulsion used in the third layer. It is clear from Table 3 that the test materials using the emulsions G4 to G6, H4 to H6, I4 to I6 and J4 to J6 of this invention have a high speed, excellent latent image storing properties and exhibit little pressure fogging. Furthermore, it is clear that the excellent properties such as those of the emulsions of the present invention are not be sufficiently obtained merely by providing a partial structure having halogen composition differences.

(e)
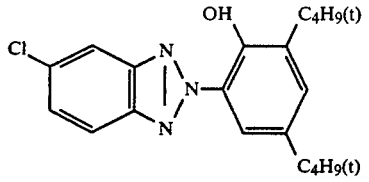
and
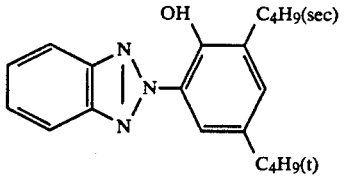
and
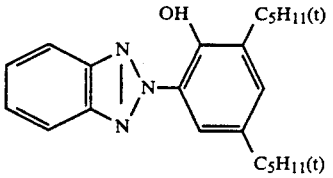
a 1:4:5 mixture (mole ratio)
(f)
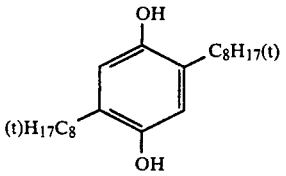
(g)
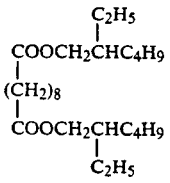
(h)
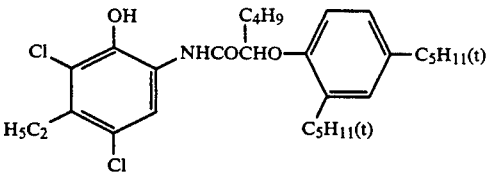
and
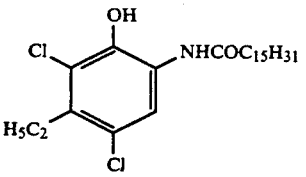
a 1:1 mixture (mole ratio)
(i)
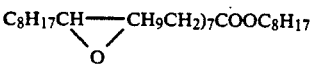
and
$(isoC_9H_{19}O)_3P{=}O$ a 2:1 mixture (mole ratio)

-continued
(j)
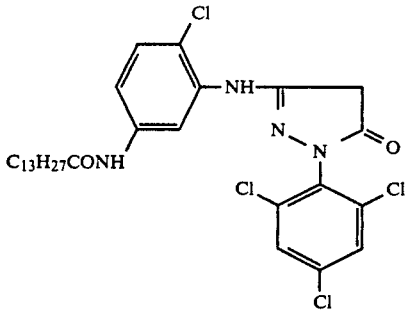
(k)
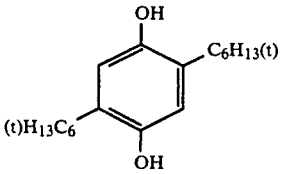
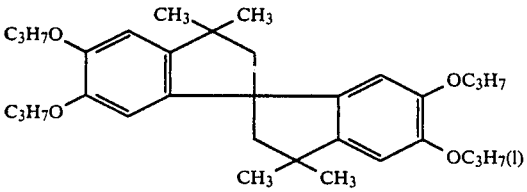
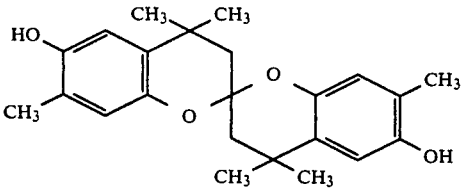
a 8:2 mixture (mole ratio)
(m)
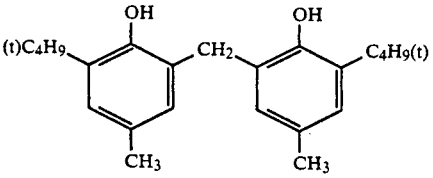
(n)
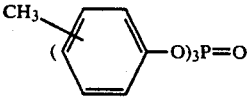
and
$(C_8H_{17}O)_3P{=}O$ a 1:2 mixture (weight ratio)
(o)
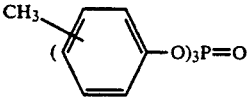
and
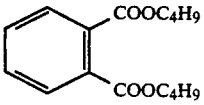
a 1:1 mixture (weight ratio)

-continued

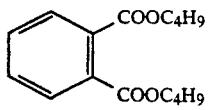

(r)

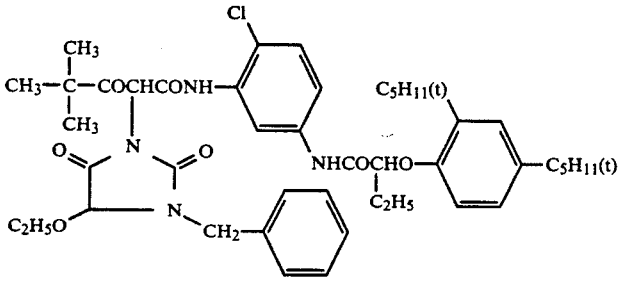

(p)

and

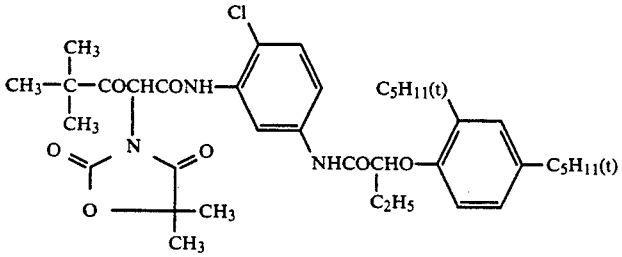

a 1:1 mixture (mole ratio)

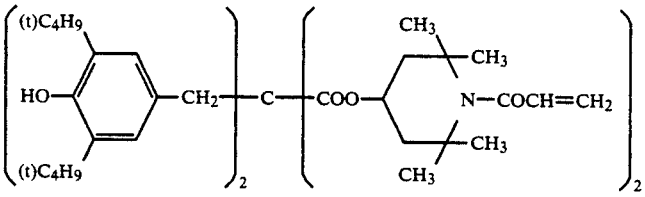

(q)

TABLE 2

| Layer | Composition | | Amount used |
|---|---|---|---|
| Layer 7 (protective layer) | Gelatin | | 1.08 g/m$^2$ |
| | Acrylic-modified polyvinyl alcohol polymer (17% modified) | | 0.12 g/m$^2$ |
| | Liquid petrolatum | | 0.04 g/m$^2$ |
| Layer 7 (ultraviolet absorption layer) | Gelatin | | 0.45 g/m$^2$ |
| | Ultraviolet absorber | (e) | 0.21 g/m$^2$ |
| | Anti color-mixing agent | (f) | 0.02 g/m$^2$ |
| | Solvent | (g) | 0.11 g/m$^2$ |
| Layer 5 (red sensitive layer) | Emulsion D5 | | 0.08 g/m$^2$ |
| | Emulsion B5 | | 0.16 g/m$^2$ |
| | Gelatin | | 0.93 g/m$^2$ |
| | Polymer | (c) | 0.38 g/m$^2$ |
| | Cyan coupler | (h) | 0.36 g/m$^2$ |
| | Colored image stabilizer | (b) | 0.17 g/m$^2$ |
| | Colored image adjuster | (d) | 0.01 g/m$^2$ |
| | Solvent | (i) | 0.23 g/m$^2$ |
| Layer 4 (ultraviolet absorption layer) | Gelatin | | 1.21 g/m$^2$ |
| | Ultraviolet absorber | (e) | 0.62 g/m$^2$ |
| | Anti color-mixing agent | (f) | 0.05 g/m$^2$ |
| | Solvent | (g) | 0.26 g/m$^2$ |
| Layer 3 (green sensitive layer) | Emulsion F1 to J7 | | 0.32 g/m$^2$ |
| | Gelatin | | 1.50 g/m$^2$ |
| | Magenta coupler | (j) | 0.42 g/m$^2$ |
| | Colored image stabilizer | (k) | 0.08 g/m$^2$ |
| | Colored image stabilizer | (l) | 0.19 g/m$^2$ |
| | Colored image stabilizer | (m) | 0.13 g/m$^2$ |
| | Solvent | (n) | 0.56 g/m$^2$ |
| Layer 2 (anti color-mixing layer) | Gelatin | | 0.99 g/m$^2$ |
| | Anti color-mixing agent | (f) | 0.09 g/m$^2$ |
| | Solvent | (0) | 0.08 g/m$^2$ |

TABLE 2-continued

| Layer | Composition | | Amount used |
|---|---|---|---|
| Layer 1 (blue sensitive layer) | Emulsion Z1 | | 0.07 g/m$^2$ |
| | Emulsion Z2 | | 0.20 g/m$^2$ |
| | Gelatin | | 1.26 g/m$^2$ |
| | Polymer | (c) | 0.16 g/m$^2$ |
| | Yellow coupler | (p) | 0.68 g/m$^2$ |
| | Colored image stabilizer | (q) | 0.07 g/m$^2$ |
| | Colored image adjuster | (d) | 0.01 g/m$^2$ |
| | Solvent | (r) | 0.27 g/m$^2$ |
| Support | Polyurethane laminated paper (including ultramarine blue and 3 g/m$^2$ of $TiO_2$ on the polyethylene support) | | |

Emulsions are shown as the coated amount calculated as silver 2,4-Dichloro-6-oxy-s-triazinic acid sodium salt was used in the emulsion layers as a gelatin hardening agent; the following compounds were also coated

| | | | |
|---|---|---|---|
| | Dye | (D-4) | 11 mg/m$^2$ |
| | Dye | (D-2) | 3 mg/m$^2$ |
| | Dye | (D-8) | 6 mg/m$^2$ |

TABLE 3

| Test material | Speed | Fog-ging | Latent image stability | Fogging | Type |
|---|---|---|---|---|---|
| F1 | 0.00 | 0.08 | −0.07 | 0.13 | Comp. ex. |
| F2 | 0.01 | 0.08 | −0.07 | 0.12 | Comp. ex. |
| F3 | 0.07 | 0.08 | −0.06 | 0.13 | Comp. ex. |
| F4 | 0.16 | 0.08 | −0.06 | 0.13 | Comp. ex. |
| F5 | 0.21 | 0.08 | −0.06 | 0.14 | Comp. ex. |
| F6 | 0.20 | 0.09 | −0.06 | 0.14 | Comp. ex. |

TABLE 3-continued

| Test material | Speed | Fog-ging | Latent image stability | Fogging | Type |
|---|---|---|---|---|---|
| F7 | 0.15 | 0.24 | −0.05 | 0.29 | Comp. ex. |
| G1 | 0.06 | 0.08 | −0.07 | 0.09 | Comp. ex. |
| G2 | 0.07 | 0.08 | −0.07 | 0.09 | Comp. ex. |
| G3 | 0.13 | 0.08 | −0.07 | 0.09 | Comp. ex. |
| G4 | 0.21 | 0.08 | −0.05 | 0.09 | This invention |
| G5 | 0.24 | 0.08 | −0.04 | 0.09 | This invention |
| G6 | 0.25 | 0.09 | −0.04 | 0.10 | This invention |
| G7 | 0.16 | 0.32 | −0.04 | 0.31 | Comp. ex. |
| H1 | 0.10 | 0.08 | −0.07 | 0.08 | Comp. ex. |
| H2 | 0.12 | 0.08 | −0.07 | 0.08 | Comp. ex. |
| H3 | 0.18 | 0.08 | −0.06 | 0.08 | Comp. ex. |
| H4 | 0.27 | 0.08 | −0.05 | 0.08 | This invention |
| H5 | 0.30 | 0.08 | −0.03 | 0.08 | This invention |
| H6 | 0.32 | 0.10 | −0.04 | 0.10 | This invention |
| H7 | 0.22 | 0.43 | −0.03 | 0.34 | Comp. ex. |
| I1 | 0.39 | 0.08 | −0.07 | 0.08 | Comp. ex. |
| I2 | 0.41 | 0.08 | −0.07 | 0.08 | Comp. ex. |
| I3 | 0.44 | 0.08 | −0.07 | 0.08 | Comp. ex. |
| I4 | 0.53 | 0.08 | −0.05 | 0.08 | This invention |
| I5 | 0.54 | 0.08 | 0.03 | 0.08 | This invention |
| I6 | 0.53 | 0.10 | 0.04 | 0.09 | This invention |
| I7 | 0.39 | 0.53 | −0.04 | 0.41 | Comp. ex. |
| J1 | 0.40 | 0.08 | −0.07 | 0.08 | Comp. ex. |
| J2 | 0.42 | 0.08 | −0.07 | 0.08 | Comp. ex. |
| J3 | 0.43 | 0.08 | −0.07 | 0.08 | Comp. ex. |
| J4 | 0.54 | 0.08 | −0.04 | 0.08 | This invention |
| J5 | 0.54 | 0.08 | −0.03 | 0.08 | This invention |
| J6 | 0.52 | 0.10 | −0.04 | 0.08 | This invention |

TABLE 3-continued

| Test material | Speed | Fog-ging | Latent image stability | Fogging | Type |
|---|---|---|---|---|---|
| J7 | 0.37 | 0.58 | −0.05 | 0.39 | Comp. ex. |

Comp. ex. = Comparative example

EXAMPLE 3

Similar test materials were prepared by adjusting the composition of Layer 3 of the test materials prepared in Example 2 as follows.

| Layer 3 | |
|---|---|
| Emulsions F1 to J7 (as silver) | 0.16 g/m$^2$ |
| Gelatin | 2.10 g/m$^2$ |
| Coupler (s) | 0.48 g/m$^2$ |
| Color image stabilizer (l) | 0.18 g/m$^2$ |
| Color image stabilizer (t) | 0.12 g/m$^2$ |
| Color image stabilizer (u) | 0.02 g/m$^2$ |
| Solvent (n) | 0.73 g/m$^2$ |

The same tests as those of Example 2 were performed. The results show that the test materials using the emulsions of the present invention displayed excellent properties with respect to high speed, pressure characteristics and the like in a similar way as in Example 2.

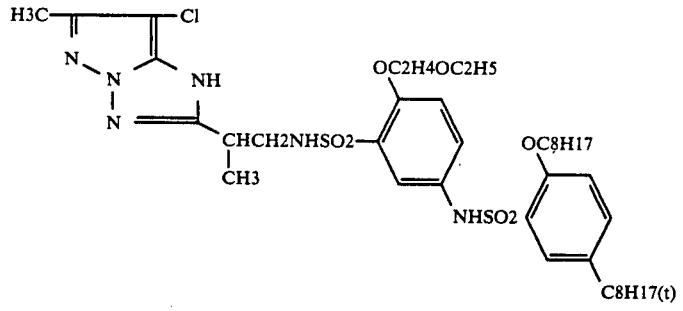

(s)

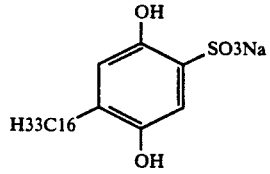

(u)

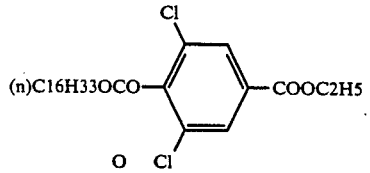

(t)

-continued

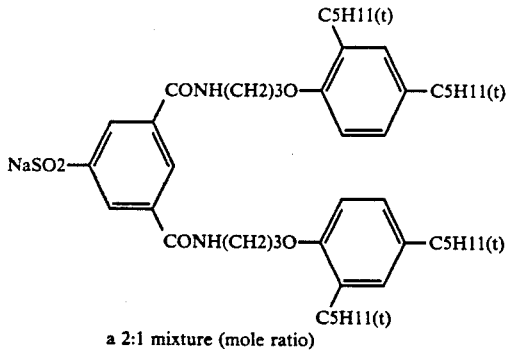

a 2:1 mixture (mole ratio)

EXAMPLE 4

The test materials used in Example 2 and Example 3 were subjected to the following processes below and tested as in Example 2. Similar results were obtained for both Example 2 and Example 3 with respect to speed and latent image stability, but differences were observed in the rate of occurrence of fogging. The values are shown in Table 4.

From the processing of these examples, It can be said that even with the emulsions B6, C6, D6, E6, G6, H6, I6 and J6 which were prepared at particularly high pH, fogging of the kind seen in Example 2 or Example 3 did not occur. A combination of the emulsions of the present invention thus provides extremely preferable results.

| Processing | Temperature | Time |
|---|---|---|
| Color development | 38° C. | 1 min. 40 sec. |
| Bleach-fixing | 35° C. | 1 min. 00 sec. |
| Rinse 1 | 33–37° C. | 20 sec. |
| Rinse 2 | 33–37° C. | 20 sec. |
| Rinse 3 | 33–37° C. | 20 sec. |
| Drying | 85° C. | 50 sec. |

(A 3 tank counter-folow system from rinse 3→1 was adopted).

The composition of each developing solution is as follows.

| | |
|---|---|
| Color developing solution | |
| Water | 800 cc |
| Ethylenediamine-N,N,N',N'-tetramethylene-phosphonic acid | 1.5 g |
| Triethanolamine | 4 cc |
| 1,4-Diazabicyclo[2,2,2]octane | 3 g |
| N,N-Diethylhydroxylamine oxalic acid salt | 3 g |
| N,N-Bis(carboxymethyl)hydrazine | 4 g |
| Potassium bromide | 0.5 g |
| Potassium carbonate | 30.0 g |
| N-Ethyl-N-(β-methanesulfonamidoethyl)-3-methyl-4-aminoaniline sulfuric acid salt | 5.5 g |
| Brightening agent (Whitex 4B, produced by Sumitomo Kagaku Co.) | 1.5 g |
| Water | to make 1,000 cc |
| pH (25° C.) | 10.15 |
| Bleach-fixing solution | |
| Water | 400 cc |
| Ammonium thiosulfate (70%) | 150 cc |
| Ammonium sulfite | 20 g |
| Iron (III) ammonium ethylenediaminetetra-acetate | 60 g |
| Diammonium ethylenediaminetetra-acetate | 10 g |
| Ammonium bromide | 6 g |
| Water | to make 1,000 cc |

-continued

| | |
|---|---|
| pH (25° C.) | 6.70 |

Rinse solution

Ion exchange water (Ca ion concentrations about 1 ppm, Mg ion concentration about 0.5 ppm).

TABLE 4

| Test material | Fogging (materials of Example 2) | Fogging (materials of Example 3) | Type |
|---|---|---|---|
| F1 | 0.08 | 0.08 | Comp. ex. |
| F2 | 0.08 | 0.08 | Comp. ex. |
| F3 | 0.08 | 0.08 | Comp. ex. |
| F4 | 0.08 | 0.08 | Comp. ex. |
| F5 | 0.08 | 0.08 | Comp. ex. |
| F6 | 0.08 | 0.08 | Comp. ex. |
| F7 | 0.13 | 0.16 | Comp. ex. |
| G1 | 0.08 | 0.08 | Comp. ex. |
| G2 | 0.08 | 0.08 | Comp. ex. |
| G3 | 0.08 | 0.08 | Comp. ex. |
| G4 | 0.08 | 0.08 | This invention |
| G5 | 0.08 | 0.08 | This invention |
| G6 | 0.08 | 0.08 | This invention |
| G7 | 0.16 | 0.20 | Comp. ex. |
| H1 | 0.08 | 0.08 | Comp. ex. |
| H2 | 0.08 | 0.08 | Comp. ex. |
| H3 | 0.08 | 0.08 | Comp. ex. |
| H4 | 0.08 | 0.08 | This invention |
| H5 | 0.08 | 0.08 | This invention |
| H6 | 0.08 | 0.08 | This invention |
| H7 | 0.21 | 0.25 | Comp. ex. |
| I1 | 0.08 | 0.08 | Comp. ex. |
| I2 | 0.08 | 0.08 | Comp. ex. |
| I3 | 0.08 | 0.08 | Comp. ex. |
| I4 | 0.08 | 0.08 | This invention |
| I5 | 0.08 | 0.08 | This invention |
| I6 | 0.08 | 0.08 | This invention |
| I7 | 0.26 | 0.30 | Comp. ex. |
| J1 | 0.08 | 0.08 | Comp. ex. |
| J2 | 0.08 | 0.08 | Comp. ex. |
| J3 | 0.08 | 0.08 | Comp. ex. |
| J4 | 0.08 | 0.08 | This invention |
| J5 | 0.08 | 0.08 | This invention |
| J6 | 0.08 | 0.08 | This invention |
| J7 | 0.31 | 0.33 | Comp. ex. |

Comp. ex. = Comparative example

While the invention has been described in detail and with reference to specific embodiments thereof, it will be apparent to one skilled in the art that various changes and modification can be made therein without departing from the spirit and scope thereof.

What is claimed is:

1. A silver halide light-sensitive photographic material comprising a support having thereon at least one photographic layer containing a chemically sensitized and spectrally sensitized silver halide emulsion, wherein said silver halide emulsion comprises silver chlorobromide crystal grains having within the crystal grain at least a two phase structure, each phase of which differing in silver bromide content by not less than 10 mol. % and wherein said crystal grains are formed in a grain forming stage at a pH of not less than 7.6 and not more than 10.8 essentially in the absence of ammonia.

2. A silver halide photographic material as in claim 1, wherein the silver halide crystal grains are mainly composed of grains enclosed in the (100) crystal plane.

3. A silver halide photographic material as in claim 1, wherein the phase structure of the silver halide crystal grains is mainly composed of a core/shell structure.

4. A silver halide photographic material as in claim 1, wherein iridium ions are contained in at least one location of the phase structure of the silver halide crystal grains.

5. A silver halide photographic material as in claim 1, wherein the silver halide crystal grains are sulfur sensitized in the present of nitrogen-containing heterocyclic mercapto compounds.

6. A silver halide photographic material as in claim 1, wherein nitrogen-containing heterocyclic mercapto compounds are contained in at least one layer above the support.

* * * * *